US009729991B2

(12) United States Patent
Walther et al.

(10) Patent No.: US 9,729,991 B2
(45) Date of Patent: Aug. 8, 2017

(54) APPARATUS AND METHOD FOR GENERATING AN OUTPUT SIGNAL EMPLOYING A DECOMPOSER

(71) Applicant: FRAUNHOFER-GESELLSCHAFT ZUR FOERDERUNG DER ANGEWANDTEN FORSCHUNG E.V., Munich (DE)

(72) Inventors: Andreas Walther, Crissier (CH); Andreas Silzle, Buckenhof (DE); Oliver Hellmuth, Erlangen (DE); Bernhard Grill, Lauf (DE); Harald Popp, Tuchenbach (DE)

(73) Assignee: Fraunhofer-Gesellschaft zur Foerderung der angewandten Forschung e.V., Munich (DE)

( * ) Notice: Subject to any disclaimer, the term of this patent is extended or adjusted under 35 U.S.C. 154(b) by 67 days.

(21) Appl. No.: 14/077,062

(22) Filed: Nov. 11, 2013

(65) Prior Publication Data

US 2014/0064527 A1 Mar. 6, 2014

Related U.S. Application Data

(63) Continuation of application No. PCT/EP2012/058433, filed on May 8, 2012.
(Continued)

(30) Foreign Application Priority Data

Sep. 19, 2011 (EP) ..... 11181828

(51) Int. Cl.
*H04R 5/02* (2006.01)
*H04S 3/00* (2006.01)

(52) U.S. Cl.
CPC ..... *H04S 3/006* (2013.01); *H04S 3/008* (2013.01)

(58) Field of Classification Search
CPC .. H04R 2420/01; H04R 1/26; H04R 2203/12; H04S 3/00; H04S 5/005; H04S 2420/01
(Continued)

(56) References Cited

U.S. PATENT DOCUMENTS 5,765,126 A 6/1998 Tsutsui et al.
7,636,443 B2 12/2009 Klayman et al.
(Continued)

FOREIGN PATENT DOCUMENTS

CN 101681625 A 3/2010
CN 101842834 A 9/2010
(Continued)

OTHER PUBLICATIONS

Avendano, Carlos et al., "A Frequency-Domain Approach to Multichannel Upmix", Journal of the Audio Engineering society, Audio, Engineering Society, vol. 52, No. 7/8, Jul. 2004, 740-749.
(Continued)

*Primary Examiner* — Alexander Jamal
(74) *Attorney, Agent, or Firm* — Perkins Coie LLP; Michael A. Glenn

(57) ABSTRACT

An apparatus for generating an output signal having at least two output channels from an input signal having at least two input channels, has an ambient/direct decomposer, an ambient modification unit and a combination unit. The ambient/direct decomposer is adapted to decompose at least two input channels of the input signal such that each one of the at least two input channels is decomposed into a signal of a first signal group and into a signal of a second signal group. The ambient modification unit is adapted to modify a signal of the ambient signal group or a signal derived from a signal
(Continued)

of the ambient signal group to obtain a modified signal as a first output channel. The combination unit is adapted to combine a signal of the ambient signal group or a signal derived from a signal of the ambient signal group and a signal of the direct signal group or a signal derived from a signal of the direct signal group as a second output channel.

27 Claims, 17 Drawing Sheets

Related U.S. Application Data

(60) Provisional application No. 61/484,962, filed on May 11, 2011.

(58) Field of Classification Search
USPC ..... 381/307, 19, 20, 21, 7, 304
See application file for complete search history.

(56) References Cited

U.S. PATENT DOCUMENTS

| | | | | |
|---|---|---|---|---|
| 2006/0165247 | A1 | 7/2006 | Mansfield et al. | |
| 2007/0165868 | A1 | 7/2007 | Klayman et al. | |
| 2007/0198356 | A1 | 8/2007 | LaCroix et al. | |
| 2008/0022685 | A1 | 1/2008 | Zhu et al. | |
| 2008/0031462 | A1* | 2/2008 | Walsh | H04S 3/02 381/17 |
| 2008/0232617 | A1* | 9/2008 | Goodwin | G10L 19/008 381/307 |
| 2009/0198356 | A1* | 8/2009 | Goodwin | G10L 19/008 700/94 |
| 2010/0177903 | A1 | 7/2010 | Vinton et al. | |
| 2010/0232619 | A1 | 9/2010 | Herre et al. | |

FOREIGN PATENT DOCUMENTS

| | | | | | |
|---|---|---|---|---|---|
| GB | 2343347 | A | * | 5/2000 | H04S 7/30 |
| JP | 2007081928 | A | | 3/2007 | |
| JP | 2008227788 | A | | 9/2008 | |
| JP | 2009077379 | A | | 4/2009 | |
| JP | 2010529780 | A | | 8/2010 | |
| JP | 2010541350 | A | | 12/2010 | |
| KR | 1020000053152 | A | | 8/2000 | |
| RU | 2131169 | C1 | | 5/1999 | |
| RU | 2005135650 | | | 3/2006 | |
| WO | WO-2008/153944 | | | 12/2008 | |
| WO | 2009049773 | A1 | | 4/2009 | |
| WO | WO-2010/027882 | | | 3/2010 | |

OTHER PUBLICATIONS

Cook, Richard et al., "Measurement of correlation coefficients in reverberant sound fields", Journal of the Acoustical Society of America, vol. 27, No. 6, pp. 1072-1077, Nov. 1955.

Duda, Richard et al., "Range dependence of the response of a spherical head model", Journal of the Acoustical Society of America, vol. 104, No. 5, pp. 3048-3058, Nov. 1998.

Faller, Christof , "Multiple-loudspeaker playback of stereo signals", Journal of the Audio Engineering Society, vol. 54, No. 11, pp. 1051-1064, Nov. 2006.

Glasberg, Brian et al., "Derivation of auditory filter shapes from notched-noise data", Hearing Research, vol. 47, pp. 103-138, 1990.

Usher, John et al., "Enhancement of spatial sound quality: A new reverberation-extraction audio upmixer", IEEE Transactions on Audio, Speech, and Language Processing, vol. 15, No. 7, pp. 2141-2150.

Walther, Andreas, "Perception and Rendering of Three-Dimensional Surround Sound", Edic Research Proposal, May 2009, pp. 1-8.

* cited by examiner cross-correlation *(r)* as a function of *kd* in two-dimensional and three-dimensional ideal diffuse sound fields IC($f_c$) for two sound sources at azimuth ± 30°, with head orientation 0° two sound sources at azimuth ± 30°, with head orientation 25°

Four sound sources at azimuth
{± 30°, ±110°}, with head orientation 25° eight sound sources at
azimuth {0°, ±45, ± 90°, ±135°, ±180},
with head orientation 25°

APPARATUS AND METHOD FOR GENERATING AN OUTPUT SIGNAL EMPLOYING A DECOMPOSER

CROSS-REFERENCE TO RELATED APPLICATIONS

This application is a continuation of copending International Application No. PCT/EP2012/058433, filed May 8, 2012, which is incorporated herein by reference in its entirety, and additionally claims priority from U.S. Provisional Application No. 61/484,962, filed May 11, 2011, and from European Application No. 11181828.2, filed Sep. 19, 2011, which are also incorporated herein by reference in their entirety.

BACKGROUND OF THE INVENTION

The present invention relates to audio processing and, in particular to an apparatus and method for generating an output signal employing a decomposer.

The human auditory system senses sound from all directions. The perceived auditory (the adjective auditory denotes what is perceived, while the word sound will be used to describe physical phenomena) environment creates an impression of the acoustic properties of the surrounding space and the occurring sound events. The auditory impression perceived in a specific sound field can (at least partially) be modeled considering three different types of signals: The direct sound, early reflections, and diffuse reflections. These signals contribute to the formation of a perceived auditory spatial image.

Direct sound denotes the waves of each sound event that first reach the listener directly from a sound source without disturbances. It is characteristic for the sound source and provides the least-compromised information about the direction of incidence of the sound event. The primary cues for estimating the direction of a sound source in the horizontal plane are differences between the left and right ear input signals, namely interaural time differences (ITDs) and interaural level differences (ILDs). Subsequently, a multitude of reflections of the direct sound arrive at the ears from different directions and with different relative time delays and levels. With increasing time delay, relative to the direct sound, the density of the reflections increases until they constitute a statistical clutter.

The reflected sound contributes to distance perception, and to the auditory spatial impression, which is composed of at least two components: apparent source width (ASW) and listener envelopment (LEV). ASW is defined as a broadening of the apparent width of a sound source and is primarily determined by early lateral reflections. LEV refers to the listener's sense of being enveloped by sound and is determined primarily by late-arriving reflections. The goal of electroacoustic stereophonic sound reproduction is to evoke the perception of a pleasing auditory spatial image. This can have a natural or architectural reference (e.g. the recording of a concert in a hall), or it may be a sound field that is not existent in reality (e.g. electroacoustic music).

From the field of concert hall acoustics, it is well known that—to obtain a subjectively pleasing sound field—a strong sense of auditory spatial impression is important, with LEV being an integral part. The ability of loudspeaker setups to reproduce an enveloping sound field by means of reproducing a diffuse sound field is of interest. In a synthetic sound field it is not possible to reproduce all naturally occurring reflections using dedicated transducers. That is especially true for diffuse later reflections. The timing and level properties of diffuse reflections can be simulated by using "reverberated" signals as loudspeakers feeds. If those are sufficiently uncorrelated, the number and location of the loudspeakers used for playback determines if the sound field is perceived as being diffuse. The goal is to evoke the perception of a continuous, diffuse sound field using only a discrete number of transducers. That is, creating sound fields where no direction of sound arrival can be estimated and especially no single transducer can be localized.

Stereophonic sound reproductions aim at evoking the perception of a continuous sound field using only a discrete number of transducers. The features desired the most are directional stability of localized sources and realistic rendering of the surrounding auditory environment. The majority of formats used today to store or transport stereophonic recordings are channel-based. Each channel conveys a signal that is intended to be played back over an associated loudspeaker at a specific position. A specific auditory image is designed during the recording or mixing process. This image is accurately recreated if the loudspeaker setup used for reproduction resembles the target setup that the recording was designed for.

Surround systems comprise a plurality of loudspeakers. Ordinary surround systems may, for example, comprise five loudspeakers. If the number of transmitted channels is smaller than the number of loudspeakers, the question arises, which signals are to be provided to which loudspeakers. For example, a surround system may comprise five loudspeakers, while a stereo signal is transmitted having two transmitted channels. On the other hand, even if a surround signal is available, the available surround signal may have fewer channels than the number of speakers of a user's surround system. For example, a surround signal having 5 surround channels may be available, while the surround system that intends to play back the surround signal may have e.g. 9 loudspeakers.

In particular in car surround systems, the surround system may comprise a plurality of loudspeakers, e.g. 9 loudspeakers. Some of these speakers may be arranged at a horizontal position with respect to a listener's seat while other speakers may be arranged at an elevated position with respect to the seat of the listener. Upmix algorithms may have to be employed to generate additional channels from the available channels of the input signal. With respect to a surround system having a plurality of horizontal and a plurality of elevated speakers, the particular problem arises which sound portions are to be played back by the elevated speakers and which sound portions are to be played back by the horizontal speakers.

SUMMARY

According to an embodiment, an apparatus for generating an output signal having at least two output channels from an input signal having at least two input channels may have: an ambient/direct decomposer being adapted to decompose at least two input channels of the input signal such that each one of the at least two input channels is decomposed into an ambient signal of an ambient signal group and into a direct signal of a direct signal group; an ambient modification unit being adapted to modify an ambient signal of the ambient signal group or a signal derived from a signal of the ambient signal group to obtain a modified ambient signal as a first output channel for a first loudspeaker; and a combination unit being adapted to combine an ambient signal of the ambient signal group or a signal derived from an ambient signal of the ambient signal group and a direct signal of the direct signal group or a signal derived from a direct signal of the direct signal group as a second output channel for a second loudspeaker.

According to another embodiment, a method for generating an output signal having at least two output channels from an input signal having at least two input channels may have the steps of: decomposing at least two input channels of the input signal such that each one of the at least two input channels is decomposed into an ambient signal of an ambient group and into a direct signal of a direct signal group; modifying an ambient signal of the ambient signal group or a signal derived from an ambient signal of the ambient signal group to obtain a modified signal as a first output channel; combining an ambient signal of the ambient signal group or a signal derived from an ambient signal of the ambient signal group and a direct signal of the direct signal group or a signal derived from a direct signal of the direct signal group as a second output channel.

According to still another embodiment, an apparatus for generating an output signal having at least four output channels from an input signal having at least two input channels may have: an ambience extractor being adapted to extract at least two ambient signals with ambient signal portions from the at least two input channels, an ambient modification unit being adapted to modify the at least two ambient signals to obtain at least a first modified ambient signal and a second modified ambient signal, at least four speakers, wherein two speakers of the at least four speakers are placed in first heights in a listening environment with respect to a listener, wherein two further speakers of the at least four speakers are placed in second heights in a listening environment with respect to a listener, the second heights being different from the first heights, wherein the ambient modification unit is adapted to feed the first modified ambient signal as a third output channel into a first speaker of the two further speakers, and wherein the ambient modification unit is adapted to feed the second modified ambient signal as a fourth output channel into a second speaker of the two further speakers, and wherein the apparatus for generating an output signal is adapted to feed the first input channel with direct and ambient signal portions as a first output channel into a first horizontally arranged speaker, and wherein the ambience extractor is adapted to feed the second input channel with direct and ambient signal portions as a second output channel into a second horizontally arranged speaker.

According to another embodiment, a method for generating an output signal having at least four output channels for at least four speakers from an input signal having at least two input channels, wherein two speakers of the at least four speakers are placed in first heights in a listening environment with respect to a listener, wherein two further speakers of the at least four speakers are placed in second heights in a listening environment with respect to a listener, the second heights being higher than the two first heights, may have the steps of: extracting at least two ambient signals with ambient signal portions from the at least two input channels, modifying the at least two ambient signals to obtain at least a first modified ambient signal and a second modified ambient signal for at least four speakers, feeding the first modified ambient signal as a third output channel into a first speaker of the two further speakers, feeding the second modified ambient signal as a fourth output channel into a second speaker of the two further speakers, feeding the first input channel with direct and ambient signal portions as a first output channel into a first horizontally arranged speaker, and feeding the second input channel with direct and ambient signal portions as a second output channel into a second horizontally arranged speaker.

Another embodiment may have a computer program for performing the above methods for generating an output signal, when the computer program is executed by a computer or processor The present invention is based on the finding that a decomposition of audio signals into perceptually distinct components is necessitated for high quality signal modification, enhancement, adaptive playback, and perceptual coding. Perceptually distinct signal components from input signals having two or more input channels should be manipulated and/or extracted.

According to the present invention, an apparatus for generating an output signal having at least two output channels from an input signal having at least two input channels is provided. The apparatus comprises an ambient/direct decomposer being adapted to decompose the first input channel into a first ambient signal of an ambient signal group and into a first direct signal of a direct signal group. The apparatus is furthermore adapted to decompose a second input channel into a second ambient signal of the ambient signal group and into a second direct signal of the direct signal group. Furthermore the apparatus comprises an ambient modification unit being adapted to modify an ambient signal of the ambient signal group or a signal derived from an ambient signal of the ambient signal group to obtain a modified ambient signal as the first output channel to a first loudspeaker. Moreover, the apparatus comprises a combination unit for combining an ambient signal of the ambient signal group or a signal derived from an ambient signal of the ambient signal group and a direct signal of the direct signal group or a signal derived from a direct signal of the direct signal group to obtain a combination signal as the second output channel to a second loudspeaker.

The present invention is based on the further finding that an ambient/direct decomposer, an ambient modification unit and a combination unit may be employed to generate decomposed, modified or combined output channels from at least two input channels of an input signal. Each channel of the input signal is decomposed by the ambient/direct decomposer into an ambient signal of an ambient signal group and into a direct signal of a direct signal group. Thus, the ambient signal group and the direct signal group together represent the sound characteristics of the input signal channels. By this, a certain amount of the ambient signal portion of a channel may be outputted to a certain loudspeaker, while, e.g. another loudspeaker may receive the remaining amount of the ambient signal portion of the channel plus the direct signal portion. It may therefore be possible to steer the amount of ambient signal portions of an input signal that is fed to a first loudspeaker and the amount of ambient signal portions of the input signal that is fed together with the direct signal portions of the input signal into a second loudspeaker.

According to an embodiment, the ambient/direct decomposer decomposes the channels of the input signal to form an ambient signal group comprising ambient signal portions of the channels of the input signal and into a direct signal group comprising direct signal portions of the input signal channels. In such an embodiment, the ambient signals of the ambient signal group and the direct signals of the direct signal group represent different signal components of the input signal channels.

In an embodiment, a signal is derived from an ambient signal of the ambient signal group by filtering, gain modifying or decorrelating the ambient signal of the ambient signal group. Furthermore, a signal may be derived from a direct signal of the direct signal group by filtering, gain modifying or decorrelating the direct signal of the direct signal group.

In a further embodiment, a first ambient gain modifier is provided wherein the ambient gain modifier is adapted to gain modify an ambient signal of the ambient signal group or a signal derived from an ambient signal of the ambient signal group to obtain a gain modified ambient signal. The combination unit of this embodiment is adapted to combine the gain modified ambient signal and a direct signal of the direct signal group or a signal derived from a direct signal of the direct signal group to obtain the combination signal as the second output signal. Both signals which are combined by the combining unit may have been generated from the same channel of the input signal. Thus, in such an embodiment, it is possible to generate an output channel with all signal components that have been already contained in the input channel, but wherein certain signal components, e.g. ambient signal components have been gain modified by the ambient gain modifier, thereby providing an output channel with a certain, gain modified, signal component characteristic.

In another embodiment, the ambient modification unit comprises a decorrelator, a second gain modifier and/or a filter unit. The filter unit may be a low-pass filter. Thus, the modification unit may provide an output channel by decorrelating, gain modifying and/or filtering, e.g. low-pass filtering, a signal of the ambient signal group. In an embodiment, the ambient signal group may comprise ambient signal portions of the channels of the input signal. Thus, it may be possible to modify ambient signal portions of the channel of the input signal.

In a further embodiment, the ambient modification unit modifies a plurality of input channels of the input signal according to the above-described concept to obtain a plurality of modified signals.

In another embodiment, an apparatus for generating an output signal having at least four output channels from an input signal having at least two input channels is provided. The apparatus comprises an ambience extractor being adapted to extract at least two ambient signals with ambient signal portions from the at least two input channels. Moreover, the apparatus comprises an ambient modification unit being adapted to modify the at least two ambient signals to obtain at least a first modified ambient signal and a second modified ambient signal. Furthermore, the apparatus comprises at least four speakers. Two speakers of the at least four speakers are placed in first heights in a listening environment with respect to a listener. Two further speakers of the at least four speakers are placed in second heights in a listening environment with respect to a listener, the second heights being different from the first heights. The ambient modification unit is adapted to feed the first modified ambient signal as a third output channel into a first speaker of the two further speakers. Furthermore, the ambient modification unit is adapted to feed the second modified ambient signal as a fourth output channel into a second speaker of the two further speakers. Moreover, the apparatus for generating an output signal is adapted to feed the first input channel with direct and ambient signal portions as a first output channel into a first speaker placed in first heights. Furthermore, the ambience extractor is adapted to feed the second input channel with direct and ambient signal portions as a second output channel into a second speaker placed in second heights.

BRIEF DESCRIPTION OF THE DRAWINGS

Embodiments of the present invention are subsequently discussed with respect to the accompanying figures, in which.

DETAILED DESCRIPTION OF THE INVENTION

Figure 1:
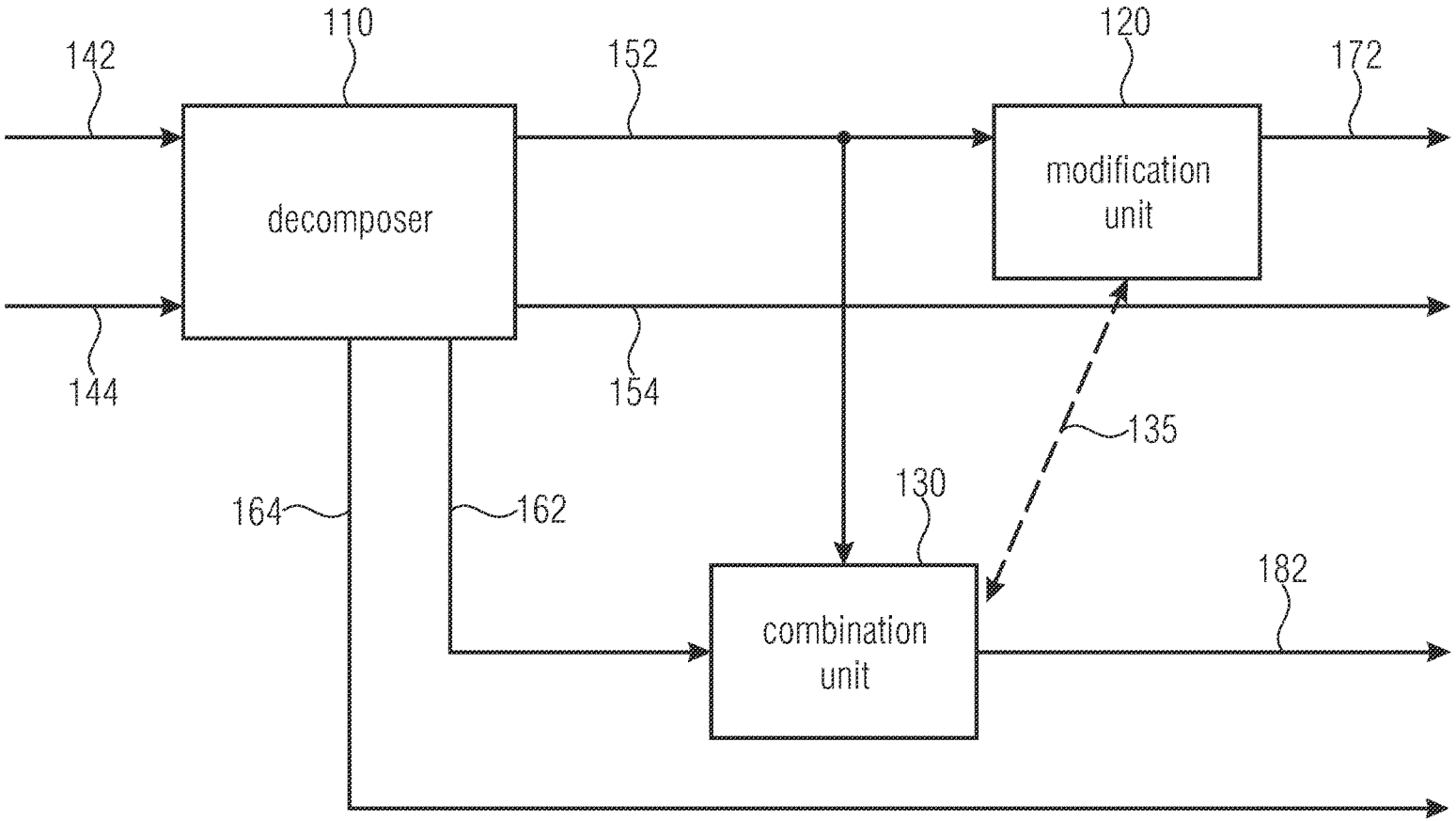
FIG. 1 illustrates a block diagram of an apparatus according to an embodiment.

FIG. 1 illustrates an apparatus according to an embodiment. The apparatus comprises an ambient/direct decomposer 110. The ambient/direct decomposer 110 is adapted to decompose two input channels 142, 144 of an input signal such that each one of the at least two input channels 142, 144 is decomposed into ambient signals 152, 154 of an ambient signal group and into direct signals 162, 164 of a direct signal group. In other embodiments, the ambient/direct decomposer 110 is adapted to decompose more than two input channels.

Moreover, the apparatus of the embodiment illustrated in FIG. 1 comprises an ambient modification unit 120. The ambient modification unit 120 is adapted to modify an ambient signal 152 of the ambient signal group to obtain a modified ambient signal 172 as a first output channel for a first loudspeaker. In other embodiments, the ambient modification unit 120 is adapted to modify a signal derived from a signal of the ambient signal group. For example, a signal of the ambient signal group may be filtered, gain modified or decorrelated and is then passed to the ambient modification unit 120 as a signal derived from a signal of the ambient signal group. In further embodiments, the ambient modification unit 120 may combine two or more ambient signals to obtain one or more modified ambient signals.

Furthermore, the apparatus of the embodiment illustrated in FIG. 1 comprises a combination unit 130. The combination unit 130 is adapted to combine an ambient signal 152 of the ambient signal group and a direct signal 162 of the direct signal group as a second output channel for a second loudspeaker. In other embodiments, the combination unit 130 is adapted to combine a signal derived from an ambient signal of the ambient signal group and/or a signal derived from a direct signal of the direct signal group. For example, an ambient signal and/or a direct signal may be filtered, gain modified or decorrelated and might then be passed to a combination unit 130. In an embodiment, the combination unit may be adapted to combine the ambient signal 152 and the direct signal 162 by adding both signals. In another embodiment, the ambient signal 152 and the direct signal 162 may be combined by forming a linear combination of the two signals 152, 162.

In the embodiment illustrated by FIG. 1, the ambient signal 154 and the direct signal 164 resulting from the decomposition of the second input channel are outputted without modification as further output channels of the output signal. However, in other embodiments, the signals 154, 164 may also be processed by the modification unit 120 and/or the combination unit 130.

In embodiments, the modification unit 120 and the combination unit 130 may be adapted to communicate with each other as illustrated by dotted line 135. Depending on this communication, the modification unit 120 may modify its received ambient signals, e.g. ambient signal 152, depending on the combinations conducted by the combination unit 130, and/or the combination unit 130 may combine its received signals, e.g. signal 152 and signal 162, depending on the modifications conducted by the modification unit 120.

The embodiment of FIG. 1 is based on the idea, that an input signal is decomposed into direct and ambient signal portions, that possibly modified signal portions are modified and outputted to a first set of loudspeakers and that a combination of the direct signal portions and the ambient signal portions of the input signal are outputted to a second set of loudspeakers.

By this, in an embodiment, e.g. a certain amount of the ambient signal portions of a channel may be outputted to a certain loudspeaker, while, e.g. another loudspeaker receives the remaining amount of the ambient signal portions of the channel plus the direct signal portion. For example, the ambient modification unit may gain modify the ambient signal 152 by multiplying its amplitudes by 0.7 to generate a first output channel. Moreover, the combination unit may combine the direct signal 162 and the ambient signal portion to generate a second output channel, wherein the ambient signal portions are multiplied by factor 0.3. By this, the modified ambient signal 172 and the combination signal 182 result to:

$$\text{signal } 172 = 0.7 \cdot \text{ambient signal portion of signal } 142$$

$$\text{signal } 182 = 0.3 \cdot \text{ambient signal portion of signal } 142 + \text{direct signal portion of signal } 142$$

Therefore, FIG. 1 is inter alia based on the idea that all signal portions of an input signal may be outputted to a listener, that at least one channel may only comprise a certain amount of the ambient signal portions of an input channel and that a further channel may comprise a combination of the remaining part of the ambient signal portions of the input channel and the direct signal portions of the input channel.

Figure 2:
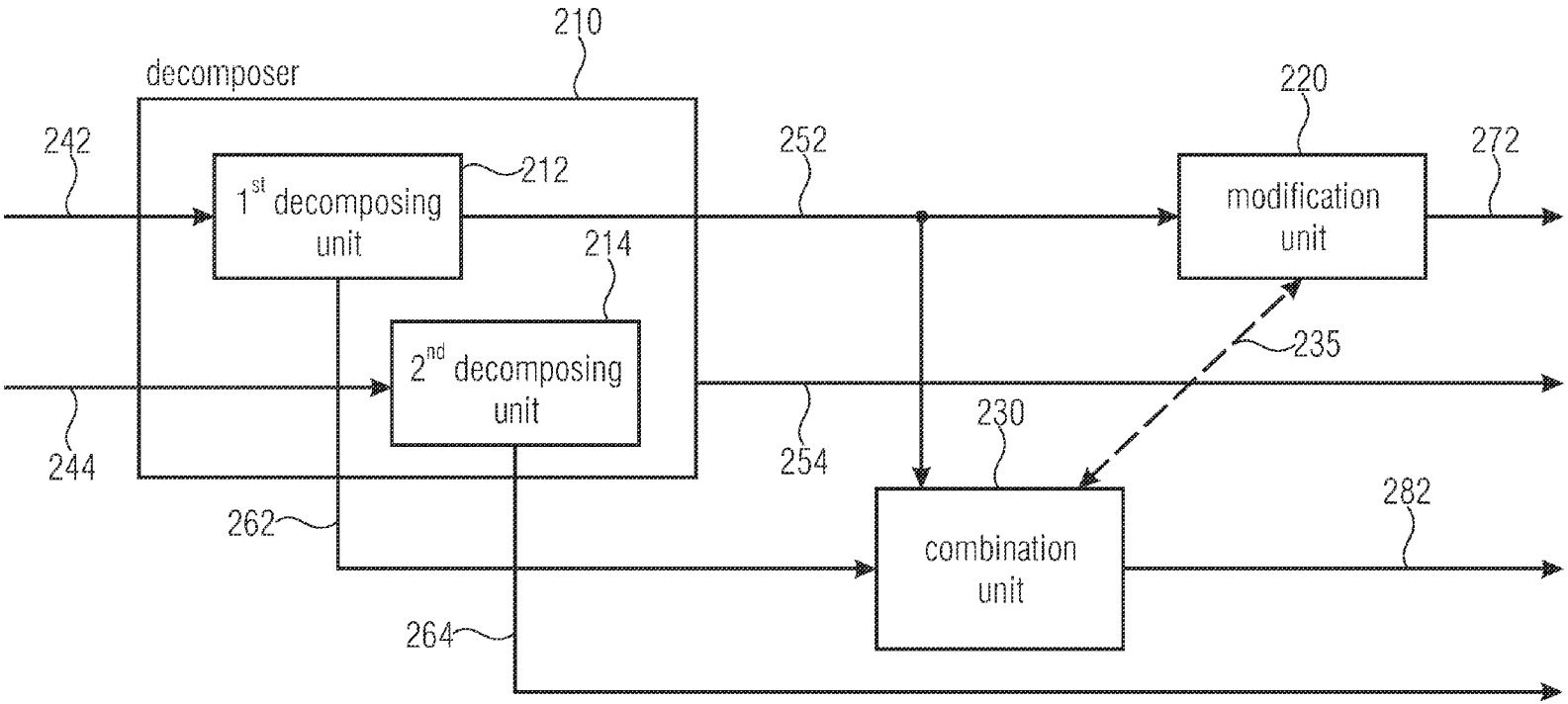
FIG. 2 depicts a block diagram of an apparatus according to a further embodiment.

FIG. 2 illustrates an apparatus according to a further embodiment illustrating more details. The apparatus comprises an ambient/direct decomposer 210, an ambient modification unit 220 and a combination unit 230 having a similar functionality as the corresponding units of the apparatus illustrated in the embodiment of FIG. 1. The ambient/direct decomposer 210 comprises a first decomposing unit 212 and a second decomposing unit 214. The first decomposing unit decomposes a first input channel 242 of an input signal of the apparatus. The first input channel 242 is decomposed into a first ambient signal 252 of an ambient signal group and into a first direct signal 262 of a direct signal group. Furthermore, the second decomposing unit 214 decomposes a second input channel 244 of the input signal into a second ambient signal 254 of the ambient signal group and into a second direct signal 264 of the direct signal group. The decomposed ambient and direct signals are processed similarly as in the apparatus of the embodiment illustrated in FIG. 1. In embodiments, the modification unit 220 and the combination unit 230 may be adapted to communicate with each other as illustrated by dotted line 235.

Figure 3:
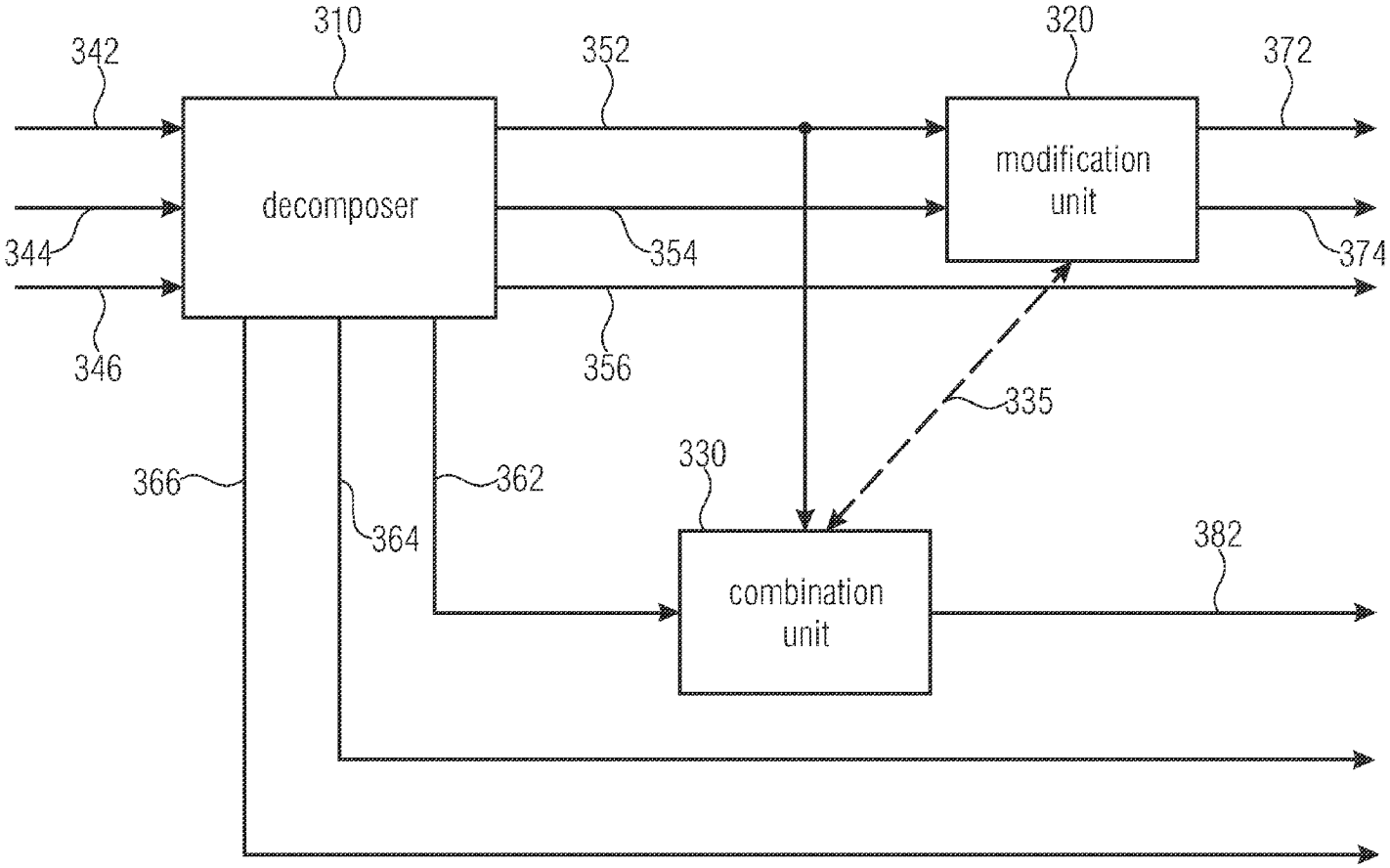
FIG. 3 shows a block diagram of an apparatus according to another embodiment.

FIG. 3 illustrates an apparatus for generating an output signal according to a further embodiment. An input signal comprising three input channels 342, 344, 346 is fed into an ambient/direct decomposer 310. The ambient/direct decomposer 310 decomposes the first input channel 342 to derive a first ambient signal 352 of an ambient signal group and a first direct signal 362 of a direct signal group. Moreover, the decomposer decomposes the second input channel 344 into a second ambient signal 354 of the ambient signal group and into a second direct signal 364 of the direct signal group. Moreover, the decomposer 310 decomposes the third input channel 346 into a third ambient signal 356 of the ambient signal group and into a third direct signal 366 of the direct signal group. In further embodiments, the number of input channels of the input signal of the apparatus is not limited to three channels, but can be any number of input channels, for example, four input channels, five input channels or nine input channels. In embodiments, the modification unit 320 and the combination unit 330 may be adapted to communicate with each other as illustrated by dotted line 335.

In the embodiment of FIG. 3, an ambient modification unit 320 modifies the first ambient signal 352 of the ambient signal group to obtain a first modified ambient signal 372.

Furthermore, the ambient modification unit 320 modifies the second ambient signal 354 of the ambient signal group to obtain a second modified ambient signal 374. In further embodiments, the ambient modification unit 320 may combine the first ambient signal 352 and the second ambient signal 354 to obtain one or more modified ambient signals.

Moreover, in the embodiment of FIG. 3, the first direct signal 362 of the direct signal group is fed into a combination unit 330 along with the first ambient signal 352 of the ambient signal group. The direct and ambient signals 362, 352 are combined by the combination unit 330 to obtain a combination signal 382. In the embodiment of FIG. 3, the combination unit combines the first direct signal 362 of the direct signal group and the first ambient signal 352 of the ambient signal group. In other embodiments, the combination unit 330 may combine any other direct signal of the direct signal group with any other ambient signal of the ambient signal group. For example, the second direct signal 364 of the direct signal group may be combined with the second ambient signal 354 of the ambient signal group. In another embodiment, the second direct signal 364 of the direct signal group may be combined with the third ambient signal 356 of the ambient signal group. In further embodiments, the combination unit 330 may combine more than one direct signal of the direct signal group and more than one ambient signal of the ambient signal group to obtain one or more combination signals.

In the embodiment of FIG. 3, the first modified ambient signal 372 is outputted as a first output channel of an output signal. The combination signal 382 is outputted as a second output channel of the output signal. The second modified ambient signal 374 is outputted as a third output channel of the output signal. Furthermore, the third ambient signal 356 of the ambient signal group and the second and third direct signals 364, 366 of the direct signal group are outputted as a fourth, fifth and sixth output channel of the output signal. In other embodiments, one or all of the signals 356, 364, 366 may not be outputted at all, but may be discarded.

Figure 4:
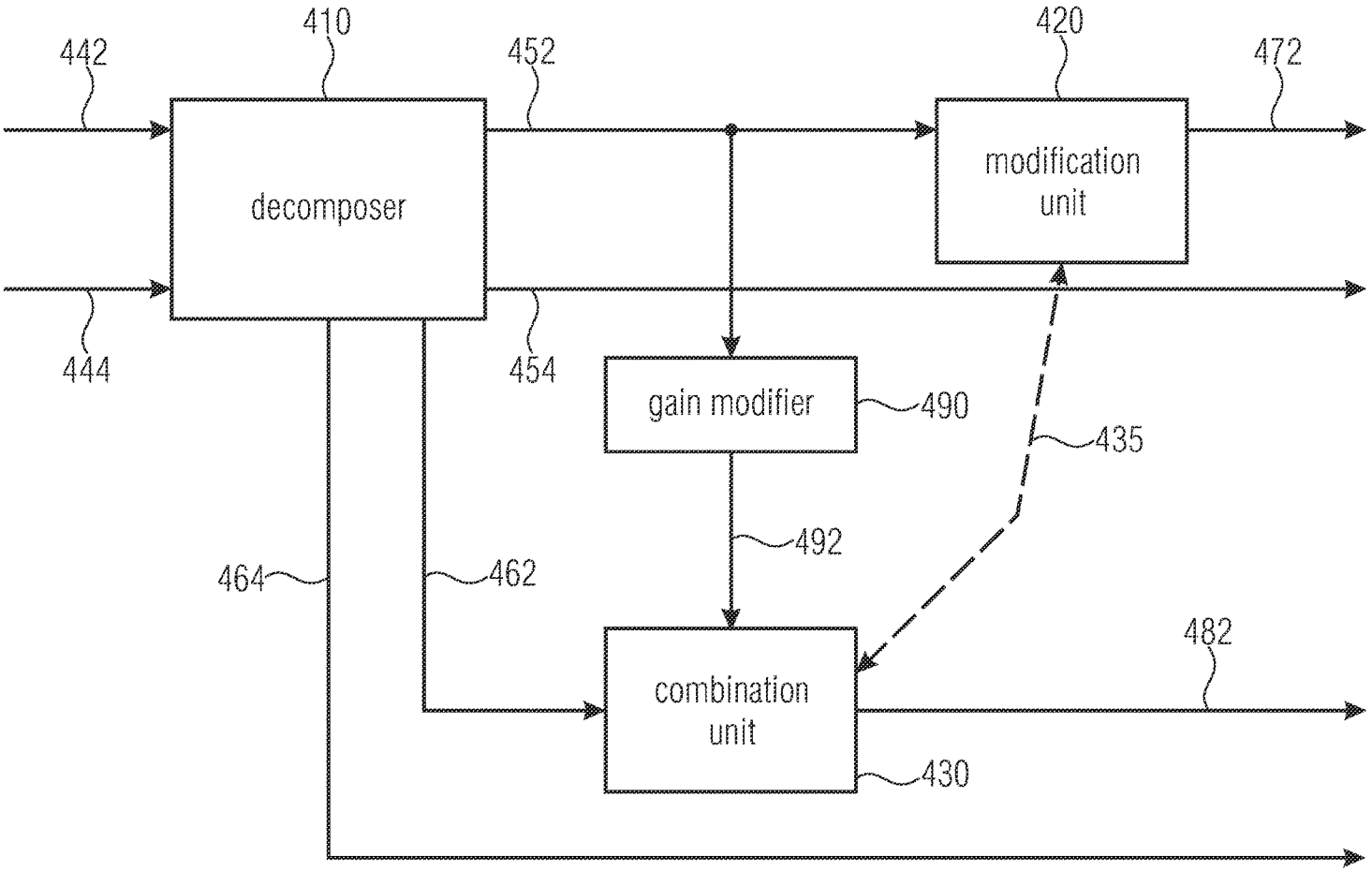
FIG. 4 illustrates a block diagram of an apparatus according to a further embodiment.

FIG. 4 illustrates an apparatus according to a further embodiment. The apparatus differs from the apparatus illustrated by FIG. 1 in that it further comprises an ambient gain modifier 490. The ambient gain modifier 490 gain modifies an ambient signal 452 of an ambient signal group to obtain a gain modified ambient signal 492 to be fed into a combination unit 490. The combination unit 430 combines the gain modified signal 492 with a direct signal 462 of a direct signal group to obtain a combination signal 482 as an output signal of the apparatus. Gain modification may be time-variant. For example, at a first point in time, a signal is gain modified with a first gain modification factor while at a different second point in time, a signal is gain modified with a different second gain modification factor.

Gain modification in the gain modifier 490 may be conducted by multiplying the amplitudes of the ambient signal 452 with a factor <1 to reduce the weight of the ambient signal 452 in the combination signal 482. This allows to add a certain amount of the ambient signal portions of an input signal to the combination signal 482, while the remaining ambient portions of the input signal may be outputted as a modified ambient signal 472.

In alternative embodiments, the multiplication factor may be >1 to increase the weight of the ambient signal 452 in the combination signal 482 which is generated by the combination unit 430. This allows to enhance the ambient signal portions and to create a different sound impression for the listener.

While in the embodiment illustrated in FIG. 4 only one ambient signal is fed into the ambient gain modifier 490, in other embodiments, more than one ambient signal may be gain modified by the ambient gain modifier 490. The gain modifier then gain modifies the received ambient signals and feeds the gain modified ambient signals into the combination unit 430.

In other embodiments, the input signal comprises more than two channels which are fed into the ambient/direct decomposer 410. As a result, the ambient signal group then comprises more than two ambient signals and also the direct signal group comprises more than two direct signals. Correspondingly, more than two channels may be also fed into the gain modifier 490 for gain modification. For example, three, four, five or nine input channels may be fed into the ambient gain modifier 490. In embodiments, the modification unit 420 and the combination unit 430 may be adapted to communicate with each other as illustrated by dotted line 435.

Figure 5:
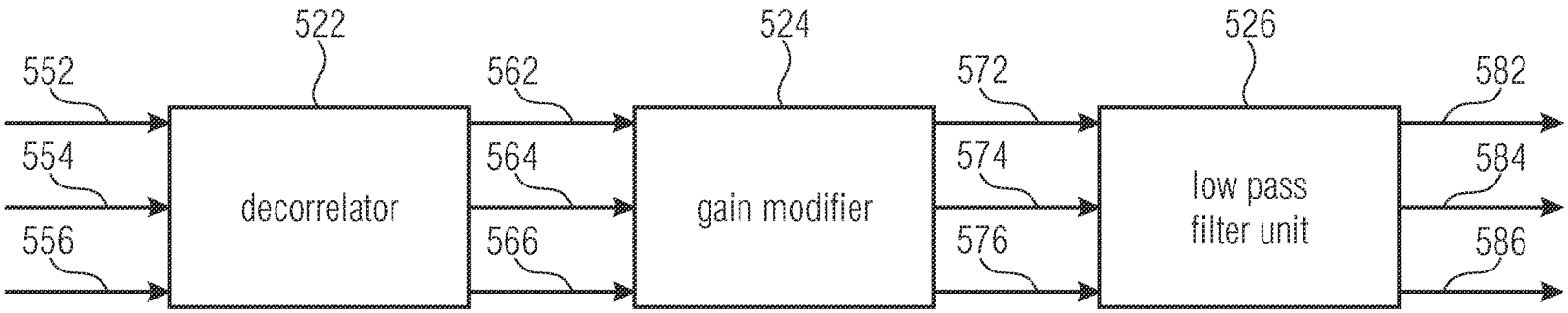
FIG. 5 illustrates a block diagram of an apparatus according to another embodiment.

FIG. 5 illustrates an ambient modification unit according to an embodiment. The ambient modification unit comprises a decorrelator 522, a gain modifier 524 and a low-pass filter 526.

In the embodiment of FIG. 5, a first 552, a second 554 and a third 556 ambient signal is fed into the decorrelator 522. In other embodiments, a different number of signals may be fed into the decorrelator 522, e.g. one ambient signal or two, four, five or nine ambient signals. The decorrelator 522 decorrelates each one of the inputted ambient signals 552, 554, 556 to obtain the decorrelated signals 562, 564, 566, respectively. The decorrelator 522 of the embodiment of FIG. 5 may be any kind of decorrelator, e.g. a lattice-all-pass filter or an IIR (Infinite Impulse Response) all-pass filter.

The decorrelated signals 562, 564, 566 are then fed into the gain modifier 524. The gain modifier gain modifies each one of the inputted signals 562, 564, 566 to obtain gain modified signals 572, 574, 576, respectively. The gain modifier 524 may be adapted to multiply the amplitudes of the inputted signals 562, 564, 566 by a factor to obtain the gain modified signals. Gain modification in the gain modifier 524 may be time-variant. For example, at a first point in time, a signal is gain modified with a first gain modification factor while at a different second point in time, a signal is gain modified with a different second gain modification factor.

Afterwards, the gain modified signals 572, 574, 576 are fed into a low-pass filter unit 526. The low-pass filter unit 526 low-pass filters each one of the gain modified signals 572, 574, 576 to obtain modified signals 582, 584, 586, respectively. While the embodiment of FIG. 5 employs a low-pass filter unit 526, other embodiments may apply other units, for example, frequency-selective filters or equalizers.

Figure 6:
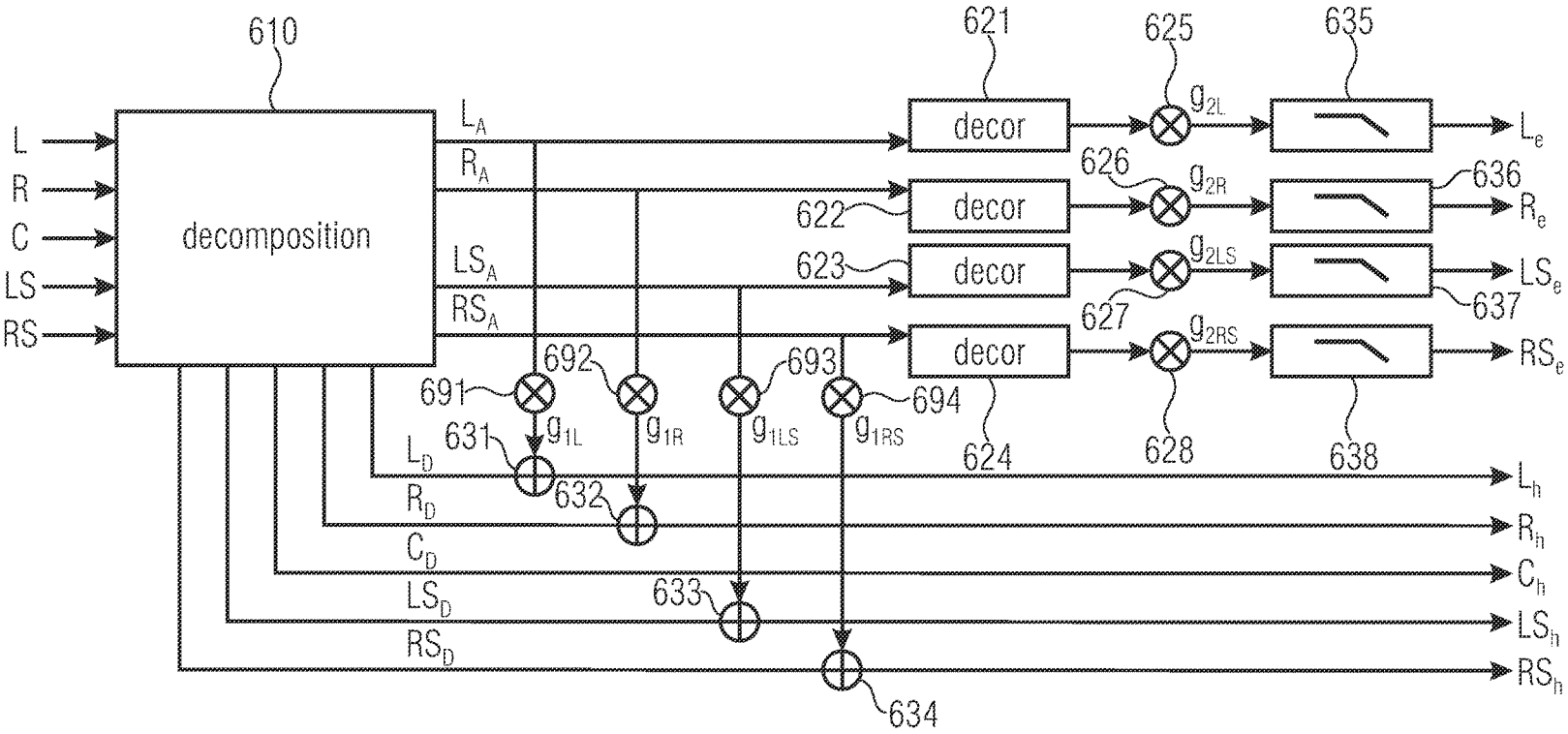
FIG. 6 shows a block diagram of an apparatus according to another embodiment.

FIG. 6 illustrates an apparatus according to a further embodiment. The apparatus generates an output signal having nine channels, e.g., five channels $L_h$, $R_h$, $C_h$, $LS_h$, $RS_h$ for horizontally arranged loudspeakers and four channels $L_e$, $R_e$, $LS_e$, $RS_e$ for elevated loudspeakers, from an input signal having five input channels. The input channels of the input signal comprise a left channel L, a right channel R, a center channel C, a left surround channel LS and a right surround channel RS.

The five input channels L, R, C, LS, RS are fed into an ambient/direct decomposer 610. The ambient/direct decomposer 610 decomposes the left signal L into an ambient signal $L_A$ of an ambient signal group and into a direct signal $L_D$ of a direct signal group. Furthermore, the ambient/direct decomposer 610 decomposes the input signal R into an ambient signal $R_A$ of an ambient signal group and into a direct signal $R_D$ of a direct signal group. Moreover the ambient/direct decomposer 610 decomposes a left surround signal LS into an ambient signal $LS_A$ of an ambient signal group and into a direct signal $LS_D$ of a direct signal group. Furthermore, the ambient/direct decomposer 610 decomposes the right surround signal RS into an ambient signal $RS_A$ of the ambient signal group and into a direct signal $RS_D$ of the direct signal group.

The ambient/direct decomposer 610 does not modify the center signal C. Instead the signal C is outputted as an output channel $C_h$ without modification.

The ambient/direct decomposer 610 feeds the ambient signal $L_A$ into a first decorrelation unit 621, which decorrelates the signal $L_A$. The ambient/direct decomposer 610 also passes the ambient signal to a first gain modification unit 691 of a first gain modifier. The first gain modification unit 691 gain modifies the signal $L_A$ and feeds the gain modified signal into a first combination unit 631. Furthermore, the signal $L_D$ is fed by the ambient/direct decomposer 610 into the first combination unit 631. The first combination unit 631 combines the gain modified signal $L_A$ and the direct signal $L_D$ to obtain an output channel $L_h$.

Furthermore, the ambient/direct decomposer 610 feeds the signals $R_A$, $LS_A$ and $RS_A$ into a second 692, a third 693 and a fourth 694 gain modification unit of a first gain modifier. The second 692, a third 693 and a fourth 694 gain modification units gain modify the received signals $R_A$, $LS_A$, and $RS_A$ respectively. The second 692, the third 693 and the fourth 694 gain modification unit then pass the gain modified signals to a second 632, a third 633 and a fourth 634 combination unit, respectively. Moreover, the ambient/direct decomposer 610 feeds the signal $R_D$ into the combination unit 632, feeds the signal $LS_D$ into the combination unit 633 and feeds the signal $RS_D$ into the combination unit 634, respectively. The combination units 632, 633, 634 then combine the signals $R_D$, $LS_D$, $RS_D$ with the gain modified signals $R_A$, $LS_A$, $RS_A$, respectively, to obtain the respective output channels $R_h$, $LS_h$, $RS_h$.

Moreover, the ambient/direct decomposer 610 feeds the signal $L_A$ into a first decorrelation unit 621, wherein the ambient signal $L_A$ is decorrelated. The first decorrelation unit 621 then passes the decorrelated signal $L_A$ into a fifth gain modification unit 625 of a second gain modifier, wherein the decorrelated ambient signal $L_A$ is gain modified. Then, the fifth gain modification unit 625 passes the gain modified ambient signal $L_A$ into a first low-passed filter unit 635, where the gain modified ambient signal is low-pass filtered to obtain a low-pass filtered ambient signal $L_e$ as an output channel of the output signal of the apparatus.

Likewise, the ambient/direct decomposer 610 passes the signals $R_A$, $LS_A$ and $RS_A$ to a second 622, third 623 and fourth 624 decorrelation unit which decorrelate the received ambient signals, respectively. The second, third and fourth decorrelation units 622, 623, 624 respectively pass the decorrelated ambient signals to a sixth 626, seventh 627 and eighth 628 gain modification unit of a second gain modifier, respectively. The sixth, seventh and eighth gain modification units 626, 627, 628 gain modify the decorrelated signals and pass the gain modified signals to a second 636, third 637 and fourth 638 low-pass filter unit, respectively. The second, third and fourth low-pass filter unit 636, 637, 638 low-pass filter the gain modified signals, respectively, to obtain low-pass filtered output signals $R_e$, $LS_e$ and $RS_e$ as output channels of the output signal of the apparatus.

In an embodiment, a modification unit may comprise the first, second, third and fourth decorrelation units 621, 622, 623, 624, the fifth, sixth, seventh and eighth gain modification units 625, 626, 627, 628 and the first, second, third and fourth low-pass filter units 635 636, 637, 638. A joint combination unit may comprise the first, second, third and fourth combination unit 631, 632, 633, 634.

In the embodiment of FIG. 6, the decomposer 610 decomposes the input channels into ambient signals $L_A$, $R_A$, $LS_A$ and $RS_A$ which are constitutes the ambient signal group and into direct signals $L_D$, $R_D$, $LS_D$ and $RS_D$ which are constitutes the direct signal group.

Figure 7:
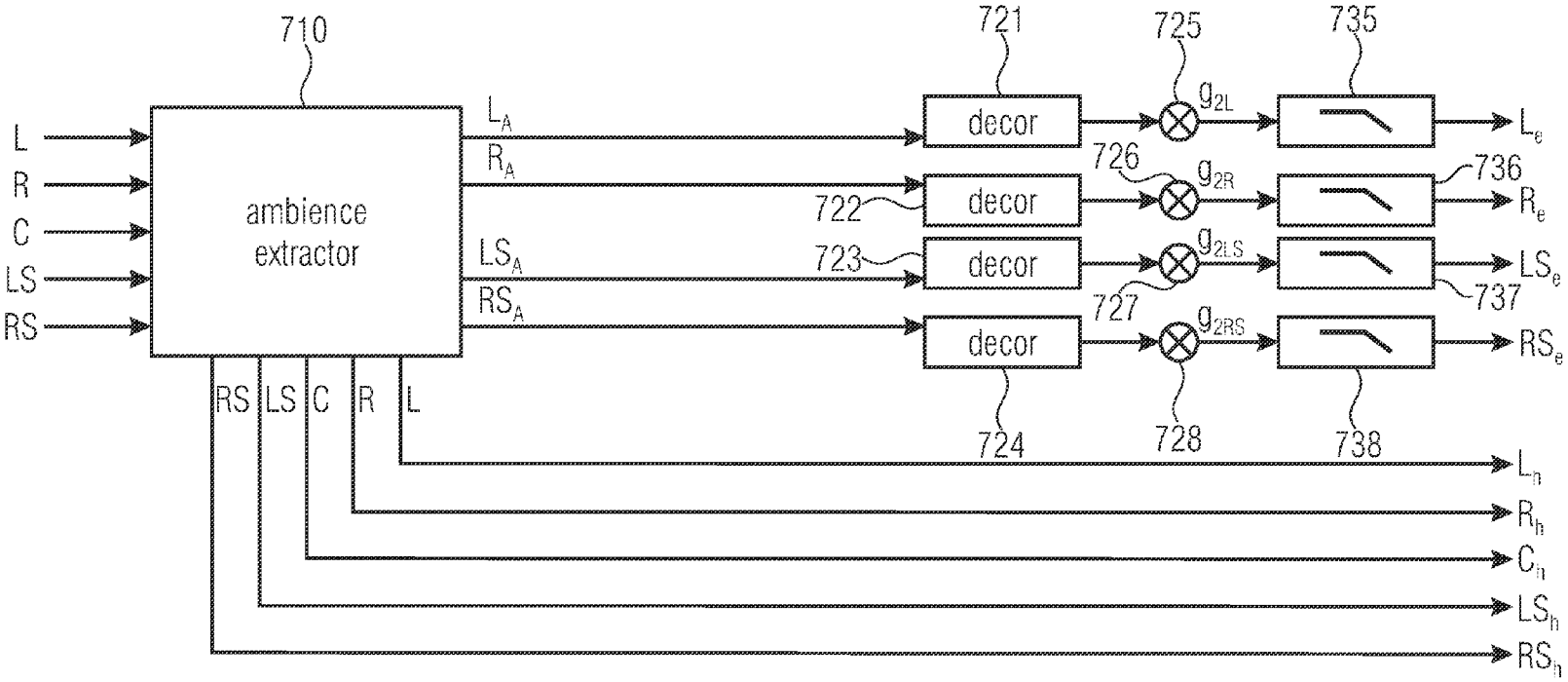
FIG. 7 depicts a block diagram of an apparatus according to a further embodiment.

FIG. 7 illustrates a block diagram of an apparatus according to an embodiment. The apparatus comprises an ambience extractor 710. An input signal comprising five channels L, R, C, LS, RS is inputted into an ambience extractor 710. The ambience extractor 710 extracts an ambient portion of channel L as an ambient channel $L_A$ and feeds the ambient channel $L_A$ into a first decorrelator unit 721. Furthermore, the ambience extractor 710 extracts ambient portions of channels R, LS, RS as ambient channels $R_A$, $LS_A$, $RS_A$ and feeds the ambient channels $R_A$, $LS_A$, $RS_A$ into a second, third and fourth decorrelator unit 722, 723, 724, respectively. Processing of the ambient signals continues in the first, second, third and fourth decorrelator units 721, 722, 723, 724, wherein the ambient signals $L_A$, $R_A$, $LS_A$, $RS_A$ are decorrelated. The decorrelated ambient signals are then gain modified in first, second, third and fourth gain modification units 725, 726, 727, 728, respectively. Afterwards, the gain-modified ambient signals are passed to first, second, third and fourth low-pass filter units 729, 730, 731, 732, wherein the gain-modified ambient signals are low-pass filtered, respectively. Afterwards, the ambient signals are outputted as a first, second, third and fourth output channel $L_e$, $R_e$, $LS_e$, $RS_e$ of the output signal, respectively.

Figure 8:
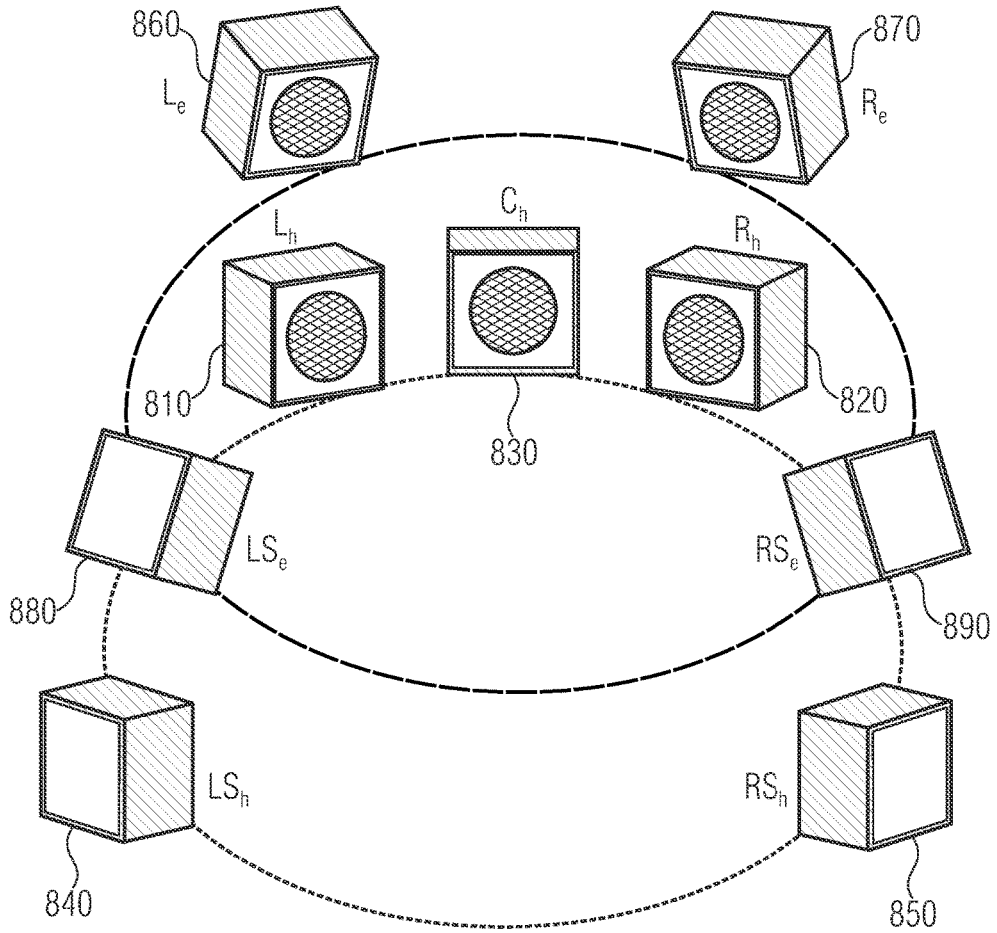
FIG. 8 illustrates a loudspeaker arrangement of an embodiment.

FIG. 8 illustrates a loudspeaker arrangement, wherein five loudspeakers 810, 820, 830, 840, 850 are placed in first heights in a listening environment with respect to a listener, and wherein loudspeakers 860, 870, 880, 890 are placed in second heights in a listening environment with respect to a listener, the second heights being different from the first heights.

The five loudspeakers 810, 820, 830, 840, 850 are horizontally arranged, i.e. are arranged horizontally with respect to an listener's position. The four other loudspeakers 860, 870, 880, 890 are elevated, i.e. are arranged such that they are arranged elevated with respect to a listener's position. In other embodiments, the loudspeakers 810, 820, 830, 840, 850 are horizontally arranged, while the four other loudspeakers 860, 870, 880, 890 are lowered, i.e. are arranged such that they are arranged lowered with respect to a listener's position. In further embodiments, one or more of the loudspeakers are horizontally arranged, one or more of the loudspeakers are elevated and one or more of the loudspeakers are lowered with respect to a listener's position.

In an embodiment, an apparatus of the embodiment illustrated by FIG. 6 generates an output signal comprising nine output channels, feeds the five output channels $L_h$, $R_h$, $C_h$, $LS_h$, $RS_h$ of the embodiment of FIG. 6 into the horizontally arranged loudspeakers 810, 820, 830, 840, 850, respectively and feeds the four output channels $L_e$, $R_e$, $LS_e$, $RS_e$ of the embodiment of FIG. 6 into the elevated loudspeakers 860,870, 880, 890, respectively.

In a further embodiment, an apparatus of the embodiment illustrated by FIG. 7 generates an output signal comprising nine output channels, feeds the five output channels L, R, C, LS, RS of the embodiment of FIG. 7 into the horizontally arranged loudspeakers 810, 820, 830, 840, 850, respectively and feeds the four output channels $L_e$, $R_e$, $LS_e$, $RS_e$ of the embodiment of FIG. 6 into the elevated loudspeakers 860, 870, 880, 890, respectively.

In an embodiment, an apparatus for generating an output signal is provided. The output signal has at least four output channels. Moreover, the output signal is generated from an input signal having at least two input channels. The apparatus comprises an ambience extractor which is adapted to extract at least two ambient signals with ambient signal portions from the at least two input channels. The ambience extractor is adapted to feed the first input channel with direct and ambient signal portions as a first output channel into a first horizontally arranged loudspeaker. Moreover, the ambience extractor is adapted to feed the second input channel with direct and ambient signal portions as the second output channel into a second horizontally arranged loudspeaker. Furthermore, the apparatus comprises an ambient modification unit. The ambient modification unit is adapted to modify the at least two ambient signals to obtain at least a first modified ambient signal and a second modified ambient signal. Furthermore, the ambient modification unit is adapted to feed the first modified ambient signal as a third output channel into a first elevated loudspeaker. Moreover, the ambient modification unit is adapted to feed the second modified ambient signal as a fourth output channel into a second elevated loudspeaker. In further embodiments, the ambient modification unit may combine a first ambient signal and a second ambient signal to obtain one or more modified ambient signals.

In an embodiment, a plurality of loudspeakers is arranged in a motor vehicle, for example, in a car. The plurality of loudspeakers are arranged as horizontally arranged loudspeakers and as elevated loudspeakers. An apparatus according to one of the above-described embodiments is employed to generate output channels. Output channels which only comprise ambient signal are fed into the elevated loudspeakers. Output channels which are combination signals comprising ambient and direct signal portions are fed into the horizontally arranged loudspeakers.

In embodiments, one, some or all of the elevated and/or horizontally arranged loudspeakers may be inclined.

Subsequently, possible configurations of an ambient/direct decomposer according to embodiments are discussed.

Various decomposers and decomposing methods that are adapted for decomposing an input signal having two channels into two ambient and two direct signals are known in the state of the art. See, for example:

C. Avendano and J.-M. Jot, "A frequency-domain approach to multichannel upmix," Journal of the Audio Engineering Society, vol. 52, no. 7/8, pp. 740-749, 2004.

C. Faller, "Multiple-loudspeaker playback of stereo signals," Journal of the Audio Engineering Society, vol. 54, no. 11, pp. 1051-1064, November 2006.

J. Usher and J. Benesty, "Enhancement of spatial sound quality: A new reverberation-extraction audio upmixer," IEEE Transactions on Audio, Speech, and Language Processing, vol. 15, no. 7, pp. 2141-2150, September 2007.

In the following and with respect to FIGS. 9-16*e*, an ambient/direct decomposer is presented, which decomposes a signal having a number of input channels into ambient and direct signal components.

Figure 9:
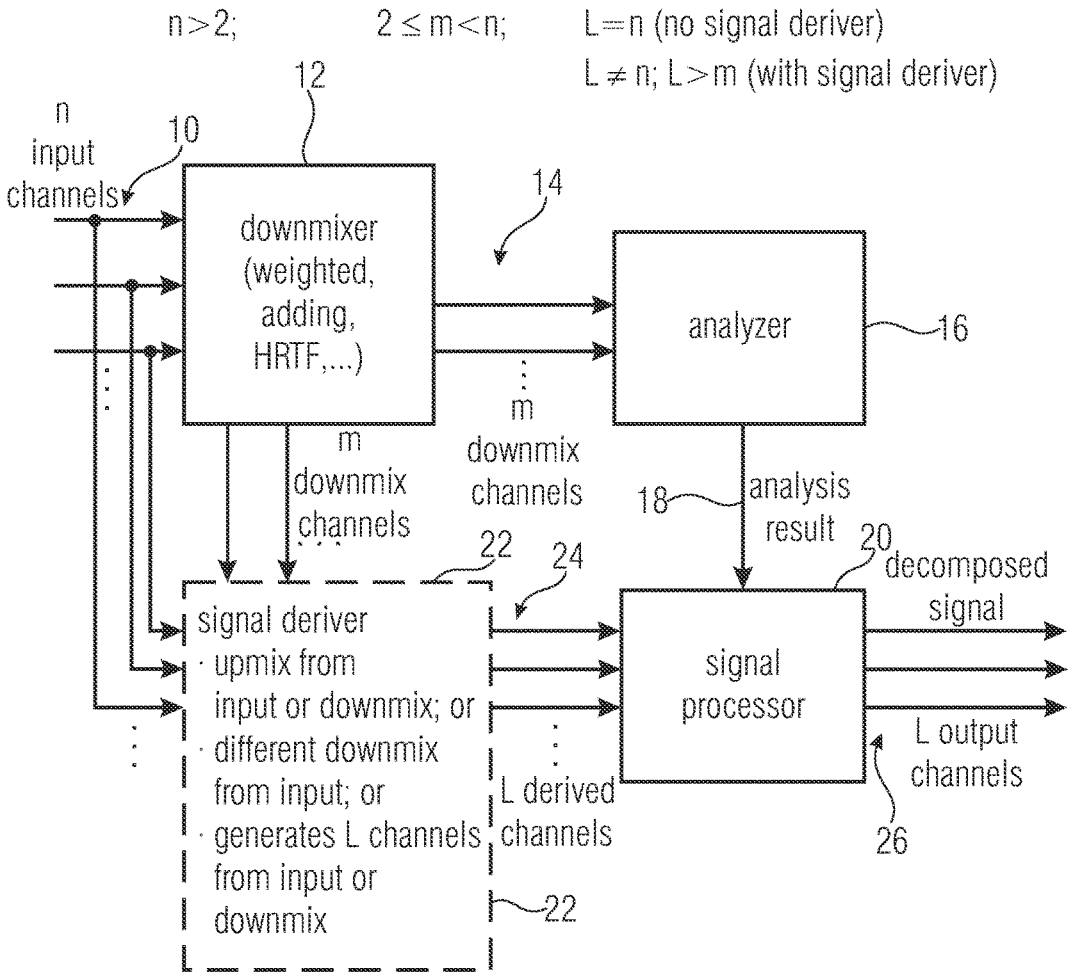
FIG. 9 is a block diagram for illustrating an ambient/direct decomposer employing a downmixer according to an embodiment.

FIG. 9 illustrates an ambient/direct decomposer for decomposing an input signal 10 having a number of at least three input channels or, generally, n input channels. These input channels are input into a downmixer 12 for downmixing the input signal to obtain a downmixed signal 14, wherein the downmixer 12 is arranged for downmixing so that a number of downmix channels of the downmixed signal 14, which is indicated by "m", is at least two and smaller than the number of input channels of the input signal 10. The m downmix channels are input into an analyzer 16 for analyzing the downmixed signal to derive an analysis result 18. The analysis result 18 is input into a signal processor 20, where the signal processor is arranged for processing the input signal 10 or a signal derived from the input signal by a signal deriver 22 using the analysis result, wherein the signal processor 20 is configured for applying the analysis results to the input channels or to channels of the signal 24 derived from the input signal to obtain a decomposed signal 26.

In FIG. 9, the number of input channels is n, the number of downmix channels is m, the number of derived channels is L, and the number of output channels is equal to L, when the derived signal rather than the input signal is processed by the signal processor. Alternatively, when the signal deriver 22 does not exist then the input signal is directly processed by the signal processor and then the number of channels of the decomposed signal 26 indicated by "L" in FIG. 9 will be equal to n. Hence, FIG. 9 illustrates two different examples. One example does not have the signal deriver 22 and the input signal is directly applied to the signal processor 20. The other example is that the signal deriver 22 is implemented and, then, the derived signal 24 rather than the input signal 10 is processed by the signal processor 20. The signal deriver may, for example, be an audio channel mixer such as an upmixer for generating more output channels. In this case L would be greater than n. In another embodiment, the signal deriver could be another audio processor which performs weighting, delay or anything else to the input channels and in this case the number of output channels of L of the signal deriver 22 would be equal to the number n of input channels. In a further implementation, the signal deriver could be a downmixer which reduces the number of channels from the input signal to the derived signal. In this implementation, it is of advantage that the number L is still greater than the number m of downmixed channels.

The analyzer is operative to analyze the downmixed signal with respect to perceptually distinct components. These perceptually distinct components can be independent components in the individual channels on the one hand, and dependent components on the other hand. Alternative signal components to be analyzed are direct components on the one hand and ambient components on the other hand. There are many other components which can be separated, such as speech components from music components, noise components from speech components, noise components from music components, high frequency noise components with respect to low frequency noise components, in multi-pitch signals the components provided by the different instruments, etc.

Figure 10:
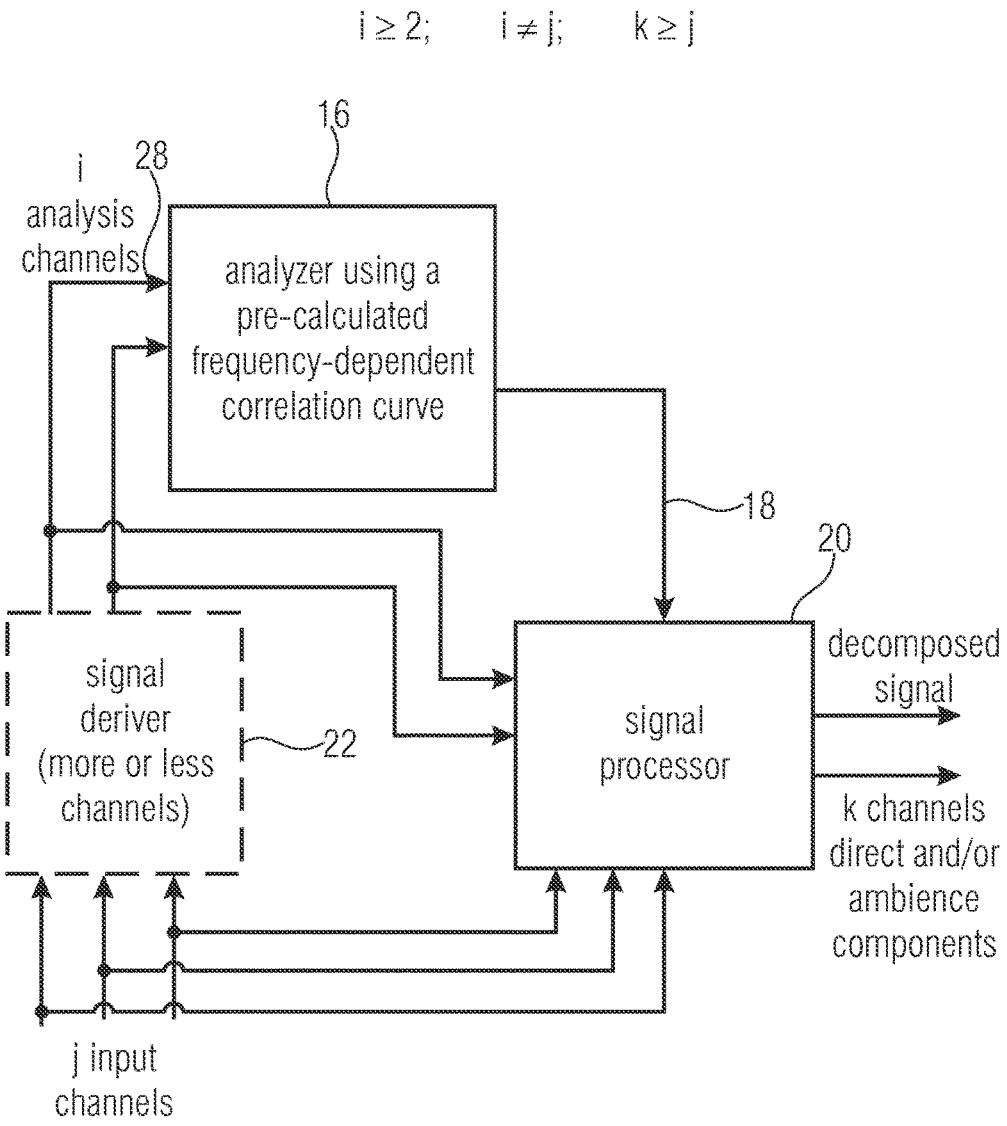
FIG. 10 is a block diagram illustrating an implementation of an ambient/direct decomposer having a number of at least three input channels using an analyzer with a pre-calculated frequency dependent correlation curve according to an embodiment.

FIG. 10 illustrates another aspect of an ambient/direct decomposer, where the analyzer is implemented for using a pre-calculated frequency-dependent correlation curve 16. Thus, the ambient/direct decomposer 28 comprises the analyzer 16 for analyzing a correlation between two channels of an analysis signal identical to the input signal or related to the input signal, for example, by a downmixing operation as illustrated in the context of FIG. 9. The analysis signal analyzed by the analyzer 16 has at least two analysis channels, and the analyzer 16 is configured for using a pre-calculated frequency dependent correlation curve as a reference curve to determine the analysis result 18. The signal processor 20 can operate in the same way as discussed in the context of FIG. 9 and is configured for processing the analysis signal or a signal derived from the analysis signal by a signal deriver 22, where the signal deriver 22 can be implemented similarly to what has been discussed in the context of the signal deriver 22 of FIG. 9. Alternatively, the signal processor can process a signal, from which the analysis signal is derived and the signal processing uses the analysis result to obtain a decomposed signal. Hence, in the embodiment of FIG. 10 the input signal can be identical to the analysis signal and, in this case, the analysis signal can also be a stereo signal having just two channels as illustrated in FIG. 10. Alternatively, the analysis signal can be derived from an input signal by any kind of processing, such as downmixing as described in the context of FIG. 9 or by any other processing such as upmixing or so. Additionally, the signal processor 20 can be useful to apply the signal processing to the same signal as has been input into the analyzer or the signal processor can apply a signal processing to a signal, from which the analysis signal has been derived such as indicated in the context of FIG. 9, or the signal processor can apply a signal processing to a signal which has been derived from the analysis signal such as by upmixing or so.

Hence, different possibilities exist for the signal processor and all of these possibilities are advantageous due to the unique operation of the analyzer using a pre-calculated frequency-dependent correlation curve as a reference curve to determine the analysis result.

Subsequently, further embodiments are discussed. It is to be noted that, as discussed in the context of FIG. 10, even the use of a two-channel analysis signal (without a downmix) is considered. As discussed in the different aspects in the context of FIG. 9 and FIG. 10, which can be used together or as separate aspects, the downmix can be processed by the analyzer or a two-channel signal, which has probably not been generated by a downmix, can be processed by the signal analyzer using the pre-calculated reference curve. In this context, it is to be noted that the subsequent description of implementation aspects can be applied to both aspects schematically illustrated in FIG. 9 and FIG. 10 even when certain features are only described for one aspect rather than both. If, for example, FIG. 11 is considered, it becomes clear that the frequency-domain features of FIG. 11 are described in the context of the aspect illustrated in FIG. 9, but it is clear that a time/frequency transform as subsequently described with respect to FIG. 11 and the inverse transform can also be applied to the implementation in FIG. 10, which does not have a downmixer, but which has a specified analyzer that uses a pre-calculated frequency dependent correlation curve.

Particularly, the time/frequency converter would be placed to convert the analysis signal before the analysis signal is input into the analyzer, and the frequency/time converter would be placed at the output of the signal processor to convert the processed signal back into the time domain. When a signal deriver exists, the time/frequency converter might be placed at an input of the signal deriver so that the signal deriver, the analyzer, and the signal processor all operate in the frequency/subband domain. In this context, frequency and subband basically mean a portion in frequency of a frequency representation.

It is furthermore clear that the analyzer in FIG. 9 can be implemented in many different ways, but this analyzer is also, in one embodiment, implemented as the analyzer discussed in FIG. 10, i.e. as an analyzer which uses a pre-calculated frequency-dependent correlation curve as an alternative to Wiener filtering or any other analysis method.

Figure 11:
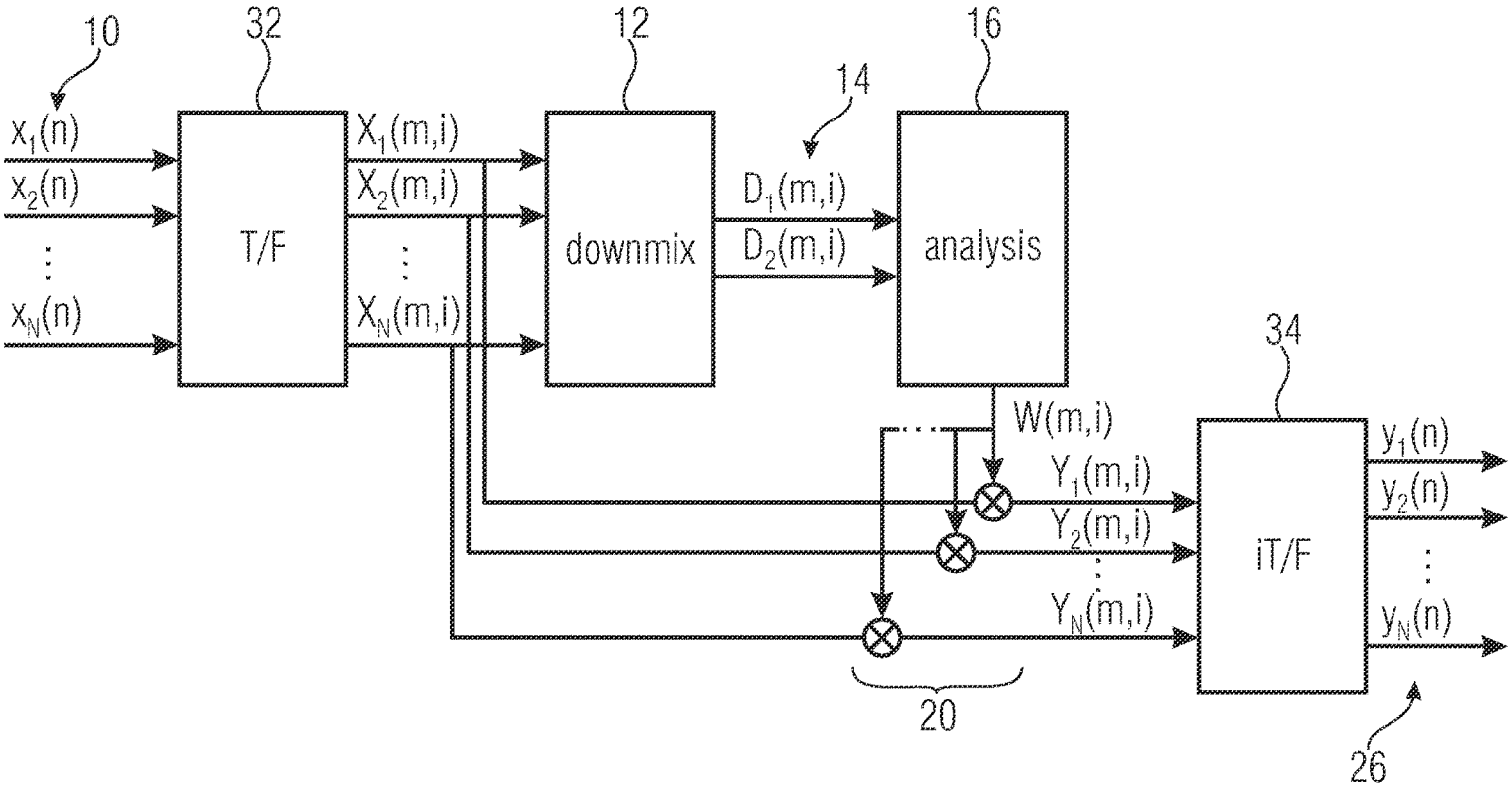
FIG. 11 illustrates a further implementation of an ambient/direct decomposer with a frequency-domain processing for the downmix, analysis and the signal processing according to an embodiment.

In FIG. 11, a downmix procedure is applied to an arbitrary input signal to obtain a two-channel representation. An analysis in the time-frequency domain is performed and weighting masks are calculated that are multiplied with the time frequency representation of the input signal, as is illustrated in FIG. 11.

In the picture, T/F denotes a time frequency transform; commonly a Short-time Fourier Transform (STFT). iT/F denotes the respective inverse transform.

$[x_1(n), \ldots, x_N(n)]$ are the time domain input signals, where n is the time index. $[X_1(m,i), \ldots, X_N(m,i)]$ denote the coefficients of the frequency decomposition, where m is the decomposition time index, and i is the decomposition frequency index.

$[D_1(m,i), D_2(m,i)]$ are the two channels of the downmixed signal.

$$\begin{pmatrix} D_1(m,i) \\ D_2(m,i) \end{pmatrix} = \begin{pmatrix} H_{11}(i) & H_{12}(i) & \ldots & H_{1N}(i) \\ H_{21}(i) & H_{22}(i) & \ldots & H_{2N}(i) \end{pmatrix} \begin{pmatrix} X_1(m,i) \\ X_2(m,i) \\ \vdots \\ X_N(m,i) \end{pmatrix} \quad (1)$$

W(m,i) is the calculated weighting. $[Y_1(m,i), \ldots, Y_N(m,i)]$ are the weighted frequency decompositions of each channel. $H_{ij}(i)$ are the downmix coefficients, which can be real-valued or complex-valued and the coefficients can be constant in time or time-variant. Hence, the downmix coefficients can be just constants or filters such as HRTF filters, reverberation filters or similar filters.

$$Y_j(m,i)=W_j(m,i)\cdot X_j(m,i), \text{ where } j=(1,2,\ldots,N) \quad (2)$$

In FIG. 11 the case of applying the same weighting to all channels is depicted.

$$Y_j(m,i)=W(m,i)\cdot X_j(m,i) \quad (3)$$

$[y_1(n), \ldots, y_N(n)]$ are the time-domain output signals comprising the extracted signal components. (The input signal may have an arbitrary number of channels (N), produced for an arbitrary target playback loudspeaker setup. The downmix may include HRTFs to obtain ear-input-signals, simulation of auditory filters, etc. The downmix may also be carried out in the time domain.).

In an embodiment, the difference between a reference correlation (Throughout this text, the term correlation is used as synonym for inter-channel similarity and may thus also include evaluations of time shifts, for which usually the term coherence is used.)

The term similarity includes the correlation and the coherence, where—in a strict—mathematical sense, the correlation is calculated between two signals without an additional time shift and the coherence is calculated by shifting the two signals in time/phase so that the signals have a maximum correlation and the actual correlation over frequency is then calculated with the time/phase shift applied. For this text, similarity, correlation and coherence are considered to mean the same, i.e., a quantitative degree of similarity between two signals, e.g., where a higher absolute value of the similarity means that the two signals are more similar and a lower absolute value of the similarity means that the two signals are less similar.

Even if time-shifts are evaluated, the resulting value may have a sign. (Commonly, the coherence is defined as having only positive values) as a function of frequency ($c_{ref}(\omega)$), and the actual correlation of the downmixed input signal ($c_{sig}(\omega)$) is computed.

Depending on the deviation of the actual curve from the reference curve, a weighting factor for each time-frequency tile is calculated, indicating if it comprises dependent or independent components. The obtained time-frequency weighting indicates the independent components and may already be applied to each channel of the input signal to yield a multichannel signal (number of channels equal to number of input channels) including independent parts that may be perceived as either distinct or diffuse.

The reference curve may be defined in different ways. Examples are:

Ideal theoretical reference curve for an idealized two- or three-dimensional diffuse sound field composed of independent components.

The ideal curve achievable with the reference target loudspeaker setup for the given input signal (e.g. Standard stereo setup with azimuth angles (±30°), or standard five channel setup according to ITU-R BS.775 with azimuth angles (0°, ±30°, ±110°).

The ideal curve for the actually present loudspeaker setup (the actual positions could be measured or known through user-input. The reference curve can be calculated assuming playback of independent signals over the given loudspeakers).

The actual frequency-dependent short time power of each input channel may be incorporated in the calculation of the reference.

Figure 12:
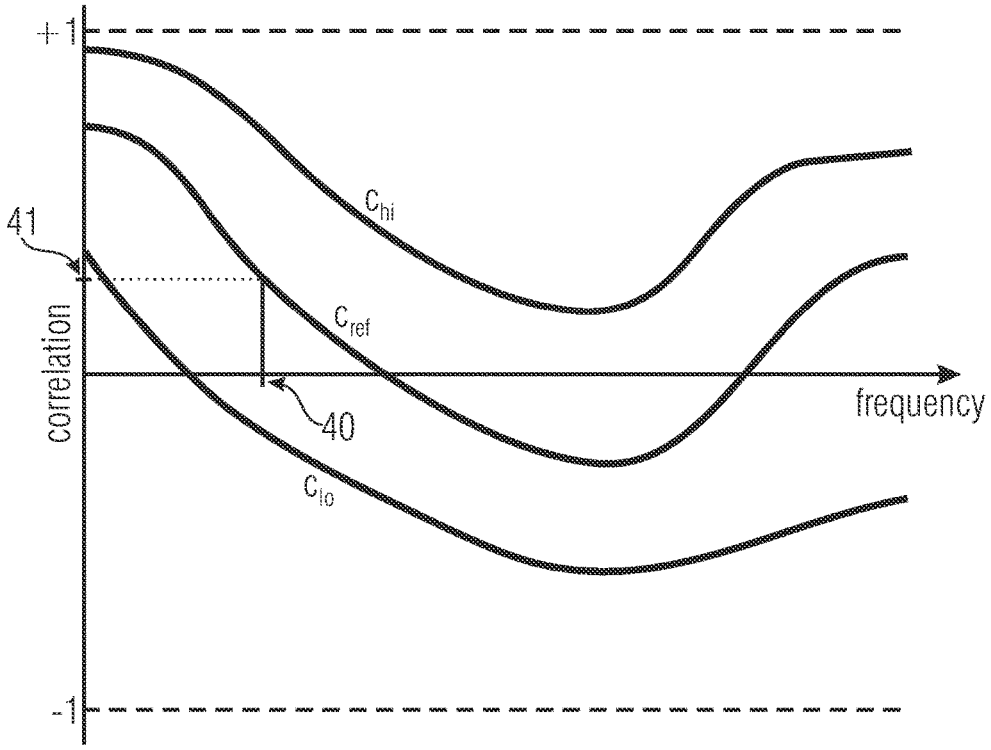
FIG. 12 illustrates an exemplary pre-calculated frequency dependent correlation curve for a reference curve for the analysis indicated in FIG. 9 or FIG. 10 for an ambient/direct decomposer according to an embodiment.

Given a frequency dependent reference curve ($c_{ref}(\omega)$), an upper threshold ($c_{hi}(\omega)$) and lower threshold ($c_{lo}(\omega)$) can be defined (see FIG. 12). The threshold curves may coincide with the reference curve ($c_{ref}(\omega)=c_{hi}(\omega)=c_{lo}(\omega)$), or be defined assuming detectability thresholds, or they may be heuristically derived.

If the deviation of the actual curve from the reference curve is within the boundaries given by the thresholds, the actual bin gets a weighting indicating independent components. Above the upper threshold or below the lower threshold, the bin is indicated as dependent. This indication may be binary, or gradually (i.e. following a soft-decision function). In particular, if the upper- and lower threshold coincides with the reference curve, the applied weighting is directly related to the deviation from the reference curve.

With reference to FIG. 11, reference numeral 32 illustrates a time/frequency converter which can be implemented as a short-time Fourier transform or as any kind of filterbank generating subband signals such as a QMF filterbank or so. Independent on the detailed implementation of the time/frequency converter 32, the output of the time/frequency converter is, for each input channel $x_i$ a spectrum for each time period of the input signal. Hence, the time/frequency processor 32 can be implemented to take a block of input samples of an individual channel signal and to calculate the frequency representation such as an FFT spectrum having spectral lines extending from a lower frequency to a higher frequency. Then, for a next block of time, the same procedure is performed so that, in the end, a sequence of short time spectra is calculated for each input channel signal. A certain frequency range of a certain spectrum relating to a certain block of input samples of an input channel is said to be a "time/frequency tile" and, advantageously, the analysis in analyzer 16 is performed based on these time/frequency tiles. Therefore, the analyzer receives, as an input for one time/frequency tile, the spectral value at a first frequency for a certain block of input samples of the first downmix channel $D_1$ and receives the value for the same frequency and the same block (in time) of the second downmix channel $D_2$.

Figure 15:
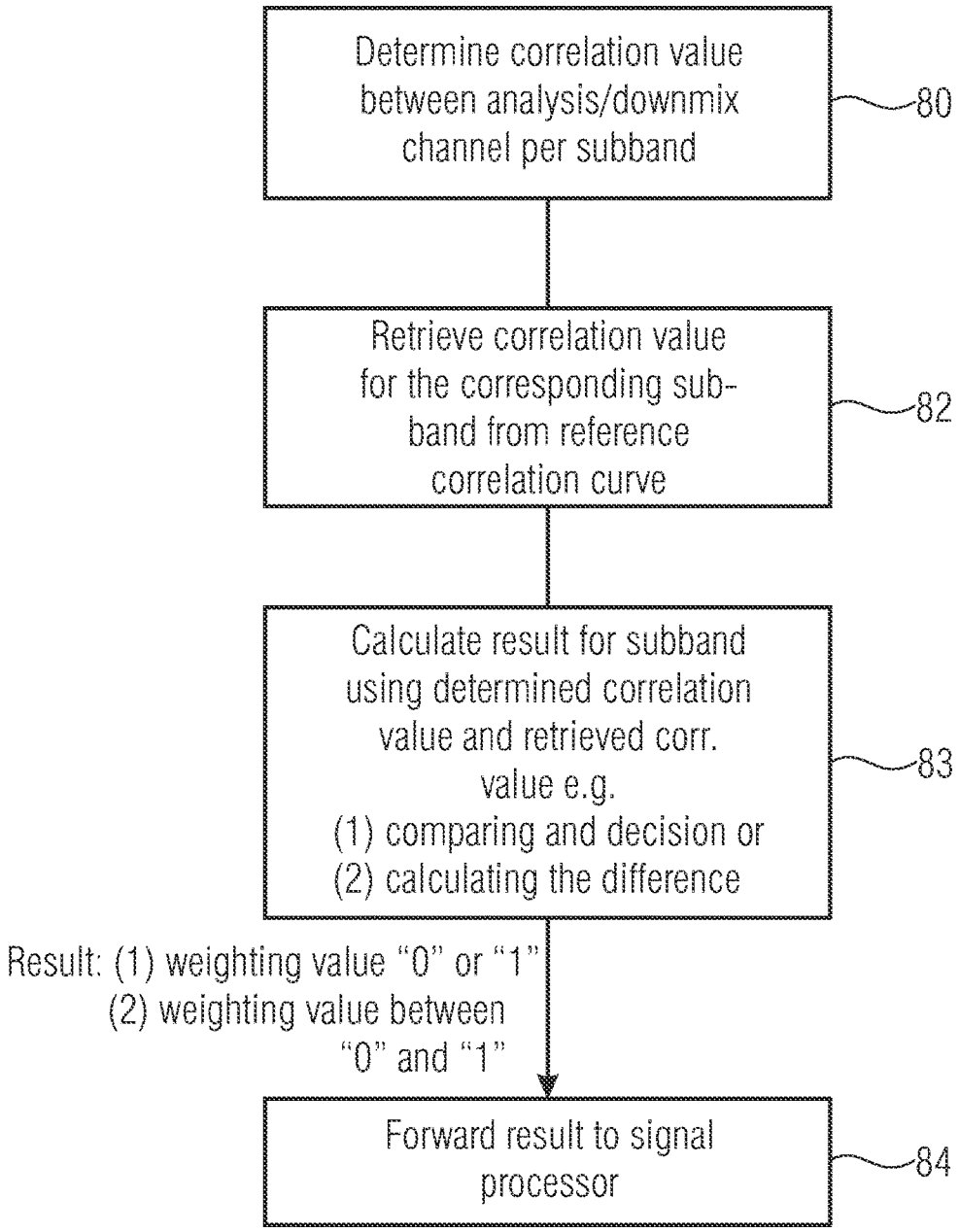
FIG. 15 illustrates a flowchart for indicating a way of processing in the signal analyzer of FIG. 9 or FIG. 10 for an ambient/direct decomposer according to an embodiment.
Figure 16A:
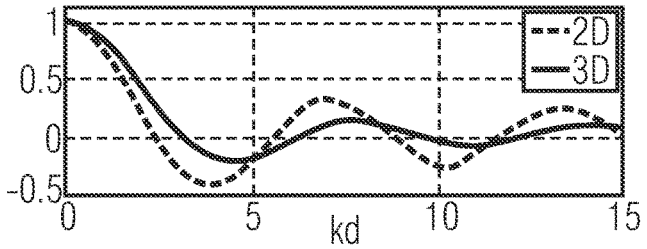
FIGS. 16*a*-16*e* illustrate different pre-calculated frequency dependent correlation curves which can be used as reference curves for several different setups with different numbers and positions of sound sources (such as loudspeakers) for an ambient/direct decomposer according to an embodiment.
Figure 16B:
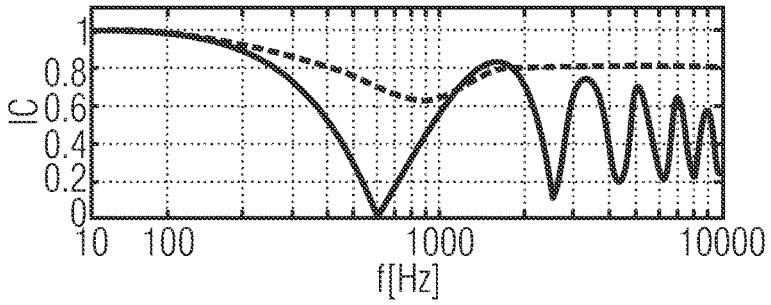
Figure 16C:
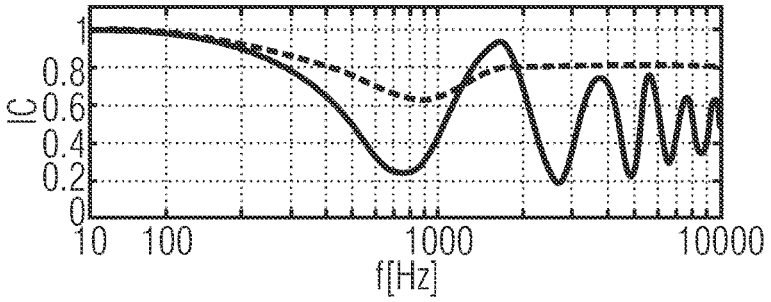
Figure 16D:
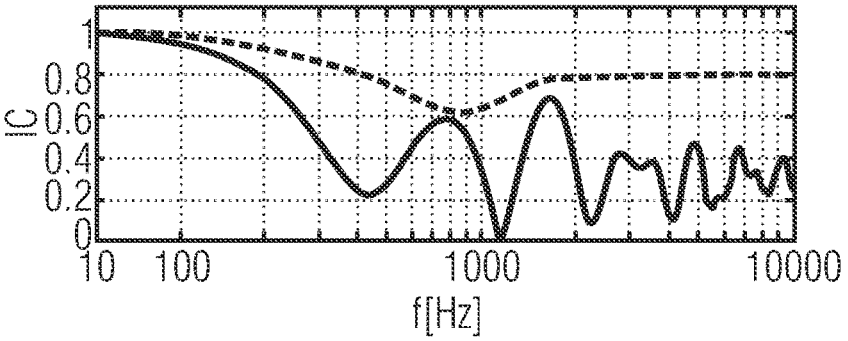
Figure 16E:
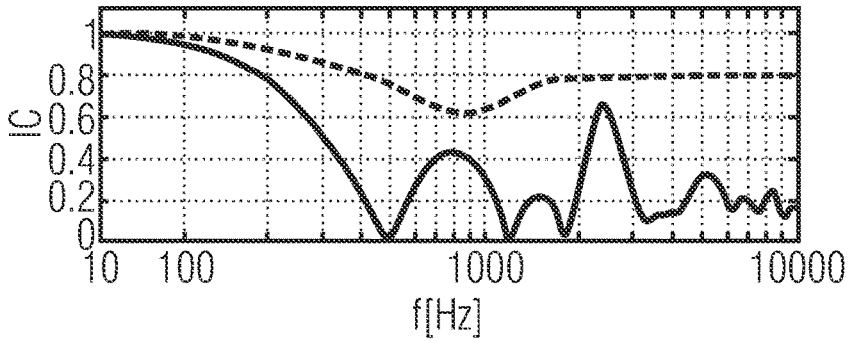

Then, as for example illustrated in FIG. 15, the analyzer 16 is configured for determining (80) a correlation value between the two input channels per subband and time block, i.e. a correlation value for a time/frequency tile. Then, the analyzer 16 retrieves, in the embodiment illustrated with respect to FIG. 10 or FIG. 12, a correlation value (82) for the corresponding subband from the reference correlation curve. When, for example, the subband is the subband indicated at 40 in FIG. 12, then the step 82 results in the value 41 indicating a correlation between −1 and +1, and value 41 is then the retrieved correlation value. Then, in step 83, the result for the subband using the determined correlation value from step 80 and the retrieved correlation value 41 obtained in step 82 is performed by performing a comparison and the subsequent decision or is done by calculating an actual difference. The result can be, as discussed before, a binary result saying that the actual time/frequency tile considered in the downmix/analysis signal has independent components. This decision will be taken, when the actually determined correlation value (in step 80) is equal to the reference correlation value or is quit close to the reference correlation value.

When, however, it is determined that the determined correlation value indicates a higher absolute correlation than the reference correlation value, then it is determined that the time/frequency tile under consideration comprises dependent components. Hence, when the correlation of a time/frequency tile of the downmix or analysis signal indicates a higher absolute correlation value than the reference curve, then it can be said that the components in this time/frequency tile are dependent on each other. When, however, the correlation is indicated to be very close to the reference curve, then it can be said that the components are independent. Dependent components can receive a first weighting value such as 1 and independent components can receive a second weighting value such as 0. Advantageously, as illustrated in FIG. 12, high and low thresholds which are spaced apart from the reference line are used in order to provide a better result which is more suited than using the reference curve alone.

Furthermore, with respect to FIG. 12, it is to be noted that the correlation can vary between −1 and +1. A correlation having a negative sign additionally indicates a phase shift of 180° between the signals. Therefore, other correlations only extending between 0 and 1 could be applied as well, in which the negative part of the correlation is simply made positive.

The alternative way of calculating the result is to actually calculate the distance between the correlation value determined in block 80 and the retrieved correlation value obtained in block 82 and to then determine a metric between 0 and 1 as a weighting factor based on the distance. While the first alternative (1) in FIG. 15 only results in values of 0 or 1, the possibility (2) results in values between 0 and 1 and are, in some implementations, of advantage.

The signal processor 20 in FIG. 11 is illustrated as multipliers and the analysis results are just a determined weighting factor which is forwarded from the analyzer to the signal processor as illustrated in 84 in FIG. 15 and is then applied to the corresponding time/frequency tile of the input signal 10. When for example the actually considered spectrum is the $20^{th}$ spectrum in the sequence of spectra and when the actually considered frequency bin is the $5^{th}$ frequency bin of this $20^{th}$ spectrum, then the time/frequency tile can be indicated as (20, 5) where the first number indicates the number of the block in time and the second number indicates the frequency bin in this spectrum. Then, the analysis result for time/frequency tile (20, 5) is applied to the corresponding time/frequency tile (20, 5) of each channel of the input signal in FIG. 11 or, when a signal deriver as illustrated in FIG. 9 is implemented, to the corresponding time/frequency tile of each channel of the derived signal.

Subsequently, the calculation of a reference curve is discussed in more detail. For the present invention, however, it is basically not important how the reference curve was derived. It can be an arbitrary curve or, for example, values in a look-up table indicating an ideal or desired relation of the input signals $x_j$ in the downmix signal D or, and in the context of FIG. 10 in the analysis signal. The following derivation is exemplary.

The physical diffusion of a sound field can be evaluated by a method introduced by Cook et al. (Richard K. Cook, R. V. Waterhouse, R. D. Berendt, Seymour Edelman, and Jr. M. C. Thompson, "Measurement of correlation coefficients in reverberant sound fields," *Journal Of The Acoustical Society Of America*, vol. 27, no. 6, pp. 1072-1077, November 1955), utilizing the correlation coefficient (r) of the steady state sound pressure of plane waves at two spatially separated points, as illustrated in the following equation (4)

$$r = \frac{\langle p_1(n) \cdot p_2(n) \rangle}{[\langle p_1^2(n) \rangle \cdot \langle p_2^2(n) \rangle]^{\frac{1}{2}}} \tag{4}$$

where $p_1(n)$ and $p_2(n)$ are the sound pressure measurements at two points, n is the time index, and <•> denotes time averaging. In a steady state sound field, the following relations can be derived:

$$r(k, d) = \frac{\sin(kd)}{kd} \text{(for three-dimensional sound fields), and} \tag{5}$$

$$r(k, d) = J_0(kd) \text{(for two-dimensional soundfields),} \tag{6}$$

where d is the distance between the two measurement points and $$k = \frac{2\pi}{\lambda}$$

is the wavenumber, with λ being the wavelength. (The physical reference curve r(k,d) may already be used as $C_{ref}$ for further processing.)

A measure for the perceptual diffuseness of a sound field is the interaural cross correlation coefficient (ρ), measured in a sound field. Measuring ρ implies that the distance between the pressure sensors (resp. the ears) is fixed. Including this restriction, r becomes a function of frequency with the radian frequency ω=kc, where c is the speed of sound in air. Furthermore, the pressure signals differ from the previously considered free field signals due to reflection, diffraction, and bending-effects caused by the listener's pinnae, head, and torso. Those effects, substantial for spatial hearing, are described by head-related transfer functions (HRTFs). Considering those influences, the resulting pressure signals at the ear entrances are $p_L(n,\omega)$ and $p_R(n,\omega)$. For the calculation, measured HRTF data may be used or approximations can be obtained by using an analytical model (e.g. Richard O. Duda and William L. Martens, "Range dependence of the response of a spherical head model," *Journal Of The Acoustical Society Of America*, vol. 104, no. 5, pp. 3048-3058, November 1998).

Since the human auditory system acts as a frequency analyzer with limited frequency selectivity, furthermore this frequency selectivity may be incorporated. The auditory filters are assumed to behave like overlapping bandpass filters. In the following example explanation, a critical band approach is used to approximate these overlapping bandpasses by rectangular filters. The equivalent rectangular bandwidth (ERB) may be calculated as a function of center frequency (Brian R. Glasberg and Brian C. J. Moore, "Derivation of auditory filter shapes from notched-noise data," *Hearing Research*, vol. 47, pp. 103-138, 1990). Considering that the binaural processing follows the auditory filtering, ρ has to be calculated for separate frequency channels, yielding the following frequency dependent pressure signals $$p_{\tilde{L}}(n, \omega) = \frac{1}{b(\omega)} \int_{\omega - \frac{b(\omega)}{2}}^{\omega + \frac{b(\omega)}{2}} p_L(n, \omega)\, d\omega \tag{7}$$

$$p_{\tilde{R}}(n, \omega) = \frac{1}{b(\omega)} \int_{\omega - \frac{b(\omega)}{2}}^{\omega + \frac{b(\omega)}{2}} p_R(n, \omega)\, d\omega, \tag{8}$$

where the integration limits are given by the bounds of the critical band according to the actual center frequency ω. The factors 1/b (w) may or may not be used in equations (7) and (8).

If one of the sound pressure measurements is advanced or delayed by a frequency independent time difference, the coherence of the signals can be evaluated. The human auditory system is able to make use of such a time alignment property. Usually, the interaural coherence is calculated within ±1 ms. Depending on the available processing power, calculations can be implemented using only the lag-zero value (for low complexity) or the coherence with a time advance and delay (if high complexity is possible). Throughout this document, no distinction is made between both cases.

The ideal behavior is achieved considering an ideal diffuse sound field, which can be idealized as a wave field that is composed of equally strong, uncorrelated plane waves propagating in all directions (i.e. a superposition of an infinite number of propagating plane waves with random phase relations and uniformly distributed directions of propagation). A signal radiated by a loudspeaker can be considered a plane wave for a listener positioned sufficiently far away. This plane wave assumption is common in stereophonic playback over loudspeakers. Thus, a synthetic sound field reproduced by loudspeakers consists of contributing plane waves from a limited number of directions.

Given an input signal with N channels, produced for playback over a setup with loudspeaker positions $[l_1, l_2, l_3, \ldots, l_N]$. (In the case of a horizontal only playback setup, $l_i$, indicates the azimuth angle. In the general case, $l_i$= (azimuth, elevation) indicates the position of the loudspeaker relative to the listener's head. If the setup present in the listening room differs from the reference setup, $l_i$ may alternatively represent the loudspeaker positions of the actual playback setup). With this information, an interaural coherence reference curve $\rho_{ref}$ for a diffuse field simulation can be calculated for this setup under the assumption that independent signals are fed to each loudspeaker. The signal power contributed by each input channel in each time-frequency tile may be included in the calculation of the reference curve. In the example implementation, $\rho_{ref}$ is used as $c_{ref}$.

Different reference curves as examples for frequency-dependent reference curves or correlation curves are illustrated in FIGS. 16*a* to 16*e* for a different number of sound sources at different positions of the sound sources and different head orientations as indicated in the figures (IC=interaural coherence).

Subsequently the calculation of the analysis results as discussed in the context of FIG. 15 based on the reference curves is discussed in more detail.

The goal is to derive a weighting that equals 1, if the correlation of the downmix channels is equal to the calculated reference correlation under the assumption of independent signals being played back from all loudspeakers. If the correlation of the downmix equals +1 or −1, the derived weighting should be 0, indicating that no independent components are present. In between those extreme cases, the weighting should represent a reasonable transition between the indication as independent (W=1) or completely dependent (W=0).

Given the reference correlation curve $c_{ref}(\omega)$ and the estimation of the correlation/coherence of the actual input signal played back over the actual reproduction setup ($c_{sig}(\omega)$) ($c_{sig}$ is the correlation resp. coherence of the downmix), the deviation of $c_{sig}(\omega)$ from $C_{ref}(\omega)$ can be calculated. This deviation (possibly including an upper and lower threshold) is mapped to the range [0;1] to obtain a weighting (W(m,i)) that is applied to all input channels to separate the independent components.

The following example illustrates a possible mapping when the thresholds correspond with the reference curve:

The magnitude of the deviation (denoted as Δ) of the actual curve $c_{sig}$ from the reference $C_{ref}$ is given by $$\Delta(\omega)=|c_{sig}(\omega)-c_{ref}(\omega)| \tag{9}$$

Given that the correlation/coherence is bounded between [−1;+1], the maximally possible deviation towards +1 or −1 for each frequency is given by $$\overline{\Delta}_{+}(\omega)=1-c_{ref}(\omega) \tag{10}$$

$$\overline{\Delta}_{-}(\omega)=c_{ref}(\omega)+1 \tag{11}$$

The weighting for each frequency is thus obtained from $$W(\omega)=\begin{cases}1-\dfrac{\Delta(\omega)}{\overline{\Delta}_{+}(\omega)} & c_{sig}(\omega)\geq c_{ref}(\omega)\\ 1-\dfrac{\Delta(\omega)}{\overline{\Delta}_{-}(\omega)} & c_{sig}(\omega)<c_{ref}(\omega)\end{cases} \tag{12}$$

Considering the time dependence and the limited frequency resolution of the frequency decomposition, the weighting values are derived as follows (Here, the general case of a reference curve that may change over time is given. A time-independent reference curve (i.e. $c_{ref}(i)$) is also possible):

$$W(m,i)=\begin{cases}1-\dfrac{\Delta(m,i)}{\overline{\Delta}_{+}(m,i)} & c_{sig}(m,i)\geq c_{ref}(m,i),\\ 1-\dfrac{\Delta(m,i)}{\overline{\Delta}_{-}(m,i)} & c_{sig}(m,i)<c_{ref}(m,i)\end{cases} \tag{13}$$

Such a processing may be carried out in a frequency decomposition with frequency coefficients grouped to perceptually motivated subbands for reasons of computational complexity and to obtain filters with shorter impulse responses. Furthermore, smoothing filters could be applied and compression functions (i.e. distorting the weighting in a desired fashion, additionally introducing minimum and/or maximum weighting values) may be applied.

Figure 13:
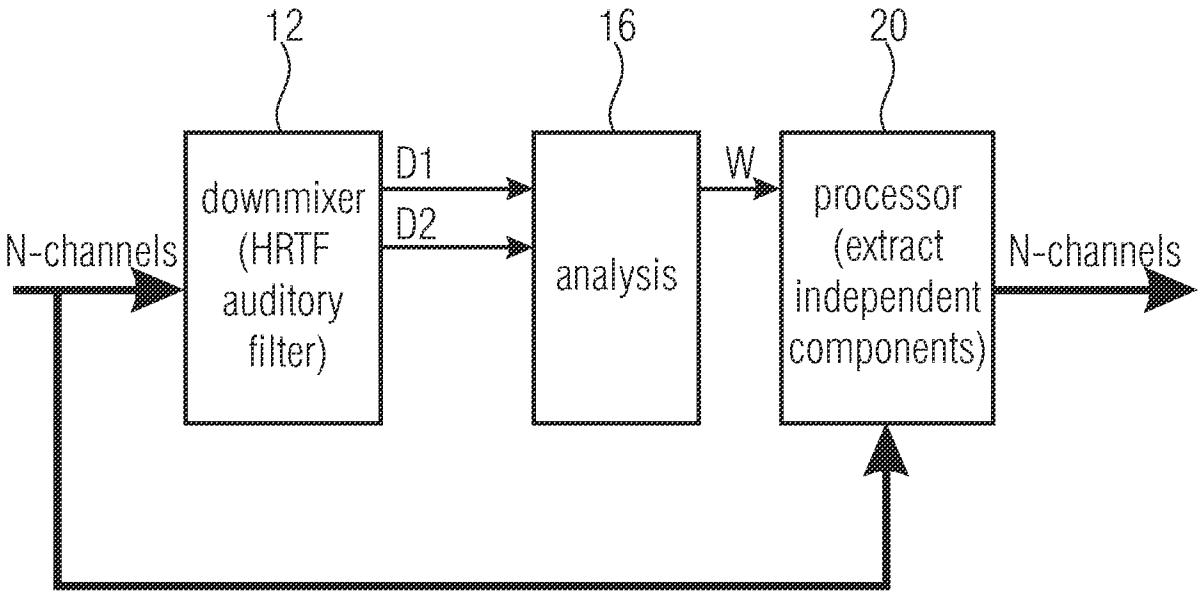
FIG. 13 illustrates a block diagram illustrating a further processing in order to extract independent components for an ambient/direct decomposer according to an embodiment.

FIG. 13 illustrates a further implementation, in which the downmixer is implemented using HRTF and auditory filters as illustrated. Furthermore, FIG. 13 additionally illustrates that the analysis results output by the analyzer 16 are the weighting factors for each time/frequency bin, and the signal processor 20 is illustrated as an extractor for extracting independent components. Then, the output of the processor 20 is, again, N channels, but each channel now only includes the independent components and does not include any more dependent components. In this implementation, the analyzer would calculate the weightings so that, in the first implementation of FIG. 15, an independent component would receive a weighting value of 1 and a dependent component would receive a weighting value of 0. Then, the time/frequency tiles in the original N channels processed by the processor 20 which have dependent components would be set to 0.

In the other alternative where there are weighting values between 0 and 1 in FIG. 15, the analyzer would calculate the weighting so that a time/frequency tile having a small distance to the reference curve would receive a high value (more close to 1), and a time/frequency tile having a large distance to the reference curve would receive a small weighting factor (being more close to 0). In the subsequent weighting illustrated, for example, in FIG. 11 at 20, the independent components would, then, be amplified while the dependent components would be attenuated.

When, however, the signal processor 20 would be implemented for not extracting the independent components, but for extracting the dependent components, then the weightings would be assigned in the opposite so that, when the weighting is performed in the multipliers 20 illustrated in FIG. 11, the independent components are attenuated and the dependent components are amplified. Hence, each signal processor can be applied for extracting the signal components, since the determination of the actually extracted signal components is determined by the actual assigning of weighting values.

Figure 14:
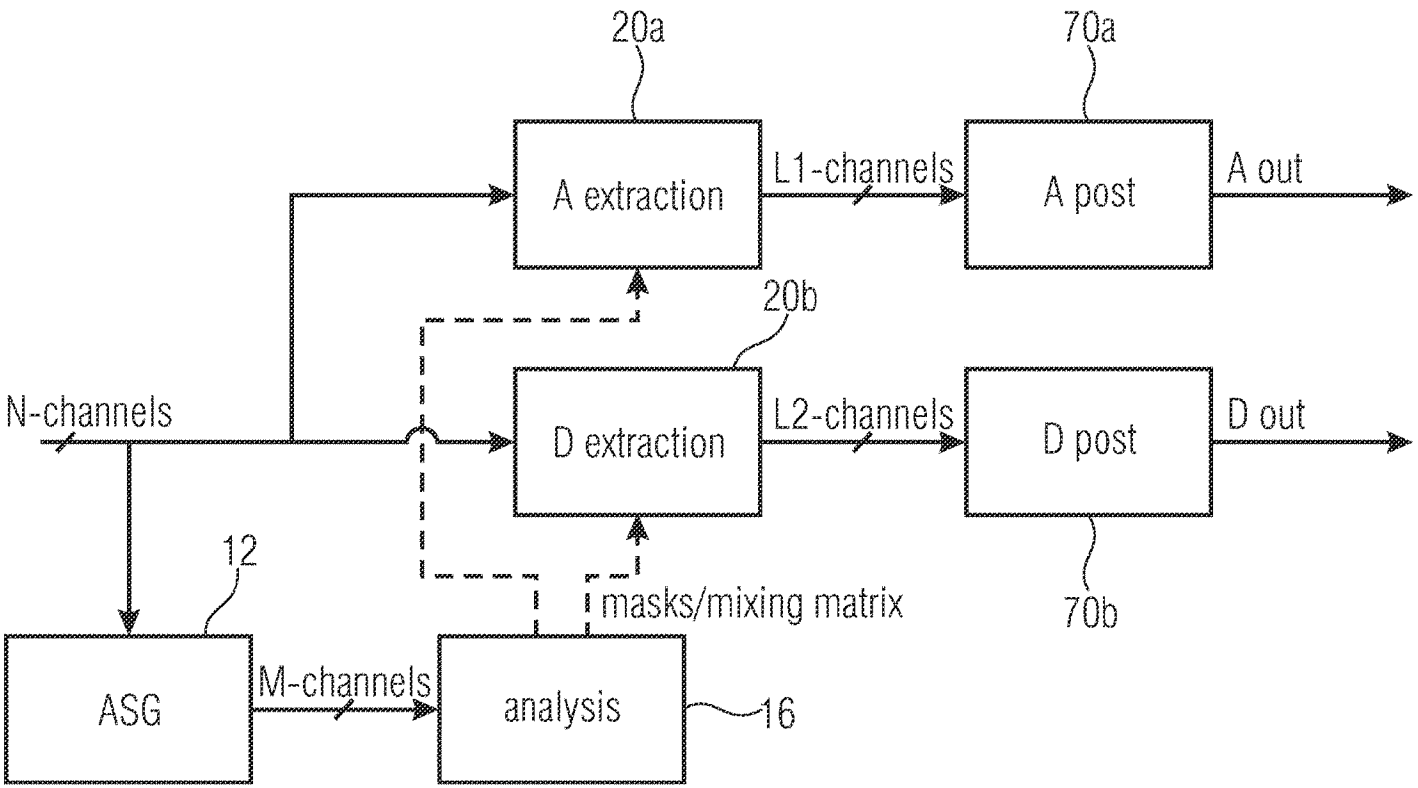
FIG. 14 illustrates a block diagram implementing a downmixer as an analysis signal generator for an ambient/direct decomposer according to an embodiment.

FIG. 14 depicts a variant of the general concept. The N-channel input signal is fed to an analysis signal generator (ASG). The generation of the M-channel analysis signal may e.g. include a propagation model from the channels/loudspeakers to the ears or other methods denoted as downmix throughout this document. The indication of the distinct components is based on the analysis signal. The masks indicating the different components are applied to the input signals (A extraction/D extraction (20*a*, 20*b*)). The weighted input signals can be further processed (A post/D post (70*a*, 70*b*) to yield output signals with specific character, where in this example the designators "A" and "D" have been chosen to indicate that the components to be extracted may be "Ambience" and "Direct Sound".

Although some aspects have been described in the context of an apparatus, it is clear that these aspects also represent a description of the corresponding method, where a block or device corresponds to a method step or a feature of a method step. Analogously, aspects described in the context of a method step also represent a description of a corresponding block or item or feature of a corresponding apparatus.

The inventive decomposed signal can be stored on a digital storage medium or can be transmitted on a transmission medium such as a wireless transmission medium or a wired transmission medium such as the Internet.

Depending on certain implementation requirements, embodiments of the invention can be implemented in hardware or in software. The implementation can be performed using a digital storage medium, for example a floppy disk, a DVD, a CD, a ROM, a PROM, an EPROM, an EEPROM or a FLASH memory, having electronically readable control signals stored thereon, which cooperate (or are capable of cooperating) with a programmable computer system such that the respective method is performed.

Some embodiments according to the invention comprise a non-transitory data carrier having electronically readable control signals, which are capable of cooperating with a programmable computer system, such that one of the methods described herein is performed.

Generally, embodiments of the present invention can be implemented as a computer program product with a program code, the program code being operative for performing one of the methods when the computer program product runs on a computer. The program code may for example be stored on a machine readable carrier.

Other embodiments comprise the computer program for performing one of the methods described herein, stored on a machine readable carrier.

In other words, an embodiment of the inventive method is, therefore, a computer program having a program code for performing one of the methods described herein, when the computer program runs on a computer.

A further embodiment of the inventive methods is, therefore, a data carrier (or a digital storage medium, or a computer-readable medium) comprising, recorded thereon, the computer program for performing one of the methods described herein.

A further embodiment of the inventive method is, therefore, a data stream or a sequence of signals representing the computer program for performing one of the methods described herein. The data stream or the sequence of signals may for example be configured to be transferred via a data communication connection, for example via the Internet.

A further embodiment comprises a processing means, for example a computer, or a programmable logic device, configured to or adapted to perform one of the methods described herein.

A further embodiment comprises a computer having installed thereon the computer program for performing one of the methods described herein.

In some embodiments, a programmable logic device (for example a field programmable gate array) may be used to perform some or all of the functionalities of the methods described herein. In some embodiments, a field programmable gate array may cooperate with a microprocessor in order to perform one of the methods described herein. Generally, the methods may be performed by any hardware apparatus.

While this invention has been described in terms of several embodiments, there are alterations, permutations, and equivalents which will be apparent to others skilled in the art and which fall within the scope of this invention. It should also be noted that there are many alternative ways of implementing the methods and compositions of the present invention. It is therefore intended that the following appended claims be interpreted as including all such alterations, permutations, and equivalents as fall within the true spirit and scope of the present invention.

The invention claimed is:

1. An apparatus for generating an output signal comprising at least two output channels from an input signal comprising at least two input channels, comprising:

an ambient/direct decomposer being adapted to decompose at least two input channels of the input signal such that each one of the at least two input channels is decomposed into an ambient signal of an ambient signal group and into a direct signal of a direct signal group;

an ambient modification unit being adapted to modify an ambient signal of the ambient signal group or a signal derived from a signal of the ambient signal group to acquire a modified ambient signal as a first output channel for a first loudspeaker of a plurality of loudspeakers; and a combination unit being adapted to combine an ambient signal of the ambient signal group or a signal derived from an ambient signal of the ambient signal group and a direct signal of the direct signal group or a signal derived from a direct signal of the direct signal group as a second output channel for a second loudspeaker of the plurality of loudspeakers, wherein the apparatus is adapted via a function only a first amount of ambient signal portions of one of the at least two input channels to one of the plurality of loudspeakers, and wherein the apparatus is adapted via a function a remaining amount of the ambient signal portions of said one of the at least two input channels plus the direct signal portions of said one of the at least two input channels to another one of the plurality of loudspeakers.

2. The apparatus according to claim 1, wherein the ambient modification unit is adapted to modify a first derived signal, wherein the first derived signal is derived by filtering, gain modifying or decorrelating an ambient signal of the ambient signal group, wherein the combination unit is adapted to modify a second derived signal, wherein the second derived signal is derived by filtering, gain modifying or decorrelating an ambient signal of the ambient signal group, and wherein the combination unit is adapted to modify a third derived signal, wherein the third derived signal is derived by filtering, gain modifying or decorrelating the direct signal of the direct signal group.

3. The apparatus according to claim 1, wherein the ambient modification unit is adapted to combine a first ambient signal of the ambient signal group and a second ambient signal of the ambient signal group to acquire a modified ambient signal.

4. The apparatus according to claim 1, wherein the apparatus further comprises a first ambient gain modifier being adapted to gain modify an ambient signal of the ambient signal group or a signal derived from an ambient signal of the ambient signal group to acquire a first gain modified ambient signal; and wherein the combination unit is adapted to combine the first gain modified ambient signal and a direct signal of the direct signal group or a signal derived from a direct signal of the direct signal group as the second output channel.

5. The apparatus according to claim 4, wherein the gain modifier is adapted to gain modify an ambient signal of the ambient signal group such that at a first point in time, the ambient signal is gain modified with a first gain modification factor while at a different second point in time, the ambient signal is gain modified with a different second gain modification factor.

6. The apparatus according to claim 1, wherein the ambient modification unit comprises a decorrelator to decorrelate a first ambient signal of the ambient signal group or a signal derived from an ambient signal of the ambient signal group to acquire the modified signal as the first output channel.

7. The apparatus according to claim 1, wherein the modification unit comprises a second ambient gain modifier being adapted to gain modify an ambient signal of the ambient signal group or a signal derived from an ambient signal of the ambient signal group to acquire the modified signal as the first output channel.

8. The apparatus according to claim 1, wherein the ambient modification unit comprises a filter unit to filter an ambient signal of the ambient signal group or a signal derived from an ambient signal of the ambient signal group to acquire the modified signal as the first output channel.

9. The apparatus according to claim 8, wherein the filter unit is adapted to employ a low pass filter.

10. The apparatus according to claim 1, wherein the combination unit is adapted to form a linear combination of an ambient signal of the ambient signal group or a signal derived from an ambient signal of the ambient signal group and a direct signal of the direct signal group or a signal derived from a direct signal of the direct signal group to generate the combination signal.

11. The apparatus according to claim 1, wherein the ambient/direct decomposer is adapted to decompose at least three input channels of the input signal, wherein the ambient/direct decomposer comprises a downmixer, an analyzer and a signal processor, wherein the downmixer is adapted to downmix the input signal to acquire a downmix signal, wherein the downmixer is configured for downmixing so that a number of downmix channels of the downmixed signal is at least 2 and smaller than the number of input channels;

wherein the analyzer is adapted to analyze the downmixed signal to derive an analysis result; and wherein the signal processor is adapted to process the input signal or a signal derived from the input signal, or a signal, from which the input signal is derived, using the analysis result, wherein the signal processor is configured for applying the analysis result to the input channels of the input signal or channels of the signal derived from the input signal to acquire the decomposed signal.

12. The apparatus according to claim 11, further comprising a time/frequency converter for converting the input channels into a time sequence of channel frequency representations, each input channel frequency representation comprising a plurality of subbands, or in which the downmixer comprises a time/frequency converter for converting the downmixed signal, wherein the analyzer is configured for generating an analysis result for individual subbands, and wherein the signal processor is configured for applying the individual analysis results to corresponding subbands of the input signal or the signal derived from the input signal.

13. The apparatus according to claim 11, wherein the analyzer is configured to produce, as the analysis result, weighting factors, and wherein the signal processor is configured for applying the weighting factors to the input signal or the signal derived from the input signal by weighting with the weighting factors.

14. The apparatus according to claim 11, wherein the analyzer is configured for using a pre-stored frequency-dependent reference curve indicating a similarity between two signals generatable by previously known reference signals.

15. A method for generating an output signal comprising at least two output channels from an input signal comprising at least two input channels, comprising:

decomposing at least two input channels of the input signal such that each one of the at least two input channels is decomposed into an ambient signal of an ambient group and into a direct signal of a direct signal group;

modifying an ambient signal of the ambient signal group or a signal derived from an ambient signal of the ambient signal group to acquire a modified signal as a first output channel;

combining an ambient signal of the ambient signal group or a signal derived from an ambient signal of the ambient signal group and a direct signal of the direct signal group or a signal derived from a direct signal of the direct signal group as a second output channel, adapting via a function so that only a first amount of ambient signal portions of one of the at least two input channels is outputted to one of a plurality of loudspeakers and wherein a remaining amount of the ambient signal portions of said one of the at least two input channels plus the direct signal portions of said one of the at least two input channels is outputted to another one of the plurality of loudspeakers.

16. An apparatus for generating an output signal comprising at least four output channels from an input signal comprising at least two input channels, comprising:

an ambience extractor being adapted to extract at least two ambient signals with ambient signal portions from the at least two input channels, an ambient modification unit being adapted to modify the at least two ambient signals to acquire at least a first modified ambient signal and a second modified ambient signal, at least four speakers, wherein two speakers of the at least four speakers are placed in first heights in a listening environment with respect to a listener, wherein two further speakers of the at least four speakers are placed in second heights in a listening environment with respect to a listener, the second heights being different from the first heights, wherein the ambient modification unit is adapted to feed only the first modified ambient signal as a third output channel into a first speaker of the two further speakers, and wherein the ambient modification unit is adapted to feed the second modified ambient signal as a fourth output channel into a second speaker of the two further speakers, and wherein the apparatus for generating an output signal is adapted to feed the first input channel with direct and ambient signal portions as a first output channel into a first horizontally arranged speaker, and wherein the ambience extractor is adapted to feed the second input channel with direct and ambient signal portions as a second output channel into a second horizontally arranged speaker, wherein the apparatus is adapted via a function to output only a first amount of ambient signal portions of one of the at least two input channels to one of the plurality of loudspeakers, and wherein the apparatus is adapted to output a remaining amount of the ambient signal portions of said one of the at least two input channels plus the direct signal portions of said one of the at least two input channels to another one of the plurality of output channels.

17. The apparatus according to claim 16, wherein the ambient modification unit is configured to feed no direct signal portions into the two further speakers or, in addition to the ambient signal portions, to feed only direct signal portions into the two further speakers which are attenuated with respect to the direct signal component fed into the two speakers.

18. A method for generating an output signal comprising at least four output channels for at least four speakers from an input signal comprising at least two input channels, wherein two speakers of the at least four speakers are placed in first heights in a listening environment with respect to a listener, wherein two further speakers of the at least four speakers are placed in second heights in a listening environment with respect to a listener, the second heights being higher than the two first heights, comprising:

extracting at least two ambient signals with ambient signal portions from the at least two input channels, modifying the at least two ambient signals to acquire at least a first modified ambient signal and a second modified ambient signal for at least four speakers, feeding only the first modified ambient signal as a third output channel into a first speaker of the two further speakers, feeding the second modified ambient signal as a fourth output channel into a second speaker of the two further speakers, feeding the first input channel with direct and ambient signal portions as a first output channel into a first horizontally arranged speaker, and feeding the second input channel with direct and ambient signal portions as a second output channel into a second horizontally arranged speaker, wherein the method comprises adapting, via a function, to output only a first amount of ambient signal portions of one of the at least two input channels to one of the plurality of output channels, and wherein the method comprises outputting a remaining amount of the ambient signal portions of said one of the at least two input channels plus the direct signal portions of said one of the at least two input channels to another one of the plurality of output channels.

19. A non-transitory computer-readable medium comprising a computer program for performing the method of claim 15, when the computer program is executed by a computer or processor.

20. A non-transitory computer-readable medium comprising a computer program for performing the method of claim 18, when the computer program is executed by a computer or processor.

21. An apparatus for generating an output signal having at least two output channels from an input signal having at least one input channel, wherein the apparatus comprises:

an ambience extractor being adapted to extract at least one ambient signal with ambient signal portions from the at least one input channel, an ambient modification unit being adapted to modify the at least one ambient signal to obtain at least a first modified ambient signal, and at least two speakers, wherein a first speaker of the at least two speakers is placed in first heights in a listening environment with respect to a listener, wherein a second speaker of the at least two speakers is placed in second heights in a listening environment with respect to the listener, the second heights being different from the first heights, wherein the apparatus for generating an output signal is adapted to feed only the first modified ambient signal into the second speaker, and wherein the apparatus for generating an output signal is adapted to feed the first input channel with direct and ambient signal portions into the first speaker being a first horizontally arranged speaker, wherein the apparatus is adapted via a function to output only a first amount of ambient signal portions of one of the at least two input channels to one of the plurality of loudspeakers, and wherein the apparatus is adapted to output a remaining amount of the ambient signal portions of said one of the at least two input channels plus the direct signal portions of said one of the at least two input channels to another one of the plurality of speakers.

22. An apparatus according to claim 21, wherein the output signal has at least four output channels being the at least two output channels, wherein the input signal has at least two input channels as the at least one audio input channel, wherein the apparatus is configured to generate the output signal having the at least four output channels from the input signal having the at least two input channels, wherein the at least one ambient signal are at least two ambient signals, wherein the ambience extractor is adapted to extract the at least two ambient signals with ambient signal portions from the at least two input channels, wherein the ambient modification unit is adapted to modify the at least two ambient signals to obtain at least the first modified ambient signal and a second modified ambient signal, wherein the at least two speakers are at least four speakers and wherein the apparatus comprises the at least four speakers, wherein the first speaker is one of two first speakers of the at least four speakers, and wherein the second speaker is one of two second speakers of the at least four speakers, wherein the two first speakers are placed in the first heights in the listening environment with respect to the listener, wherein the two second speakers are placed in the second heights in the listening environment with respect to the listener, wherein the apparatus for generating an output signal is adapted to feed the first modified ambient signal as a third output channel into one of the two second speakers, and wherein the apparatus for generating an output signal is adapted to feed the second modified ambient signal as a fourth output channel into another one of the two second speakers, and wherein the apparatus for generating an output signal is adapted to feed one of the at least two input channels with direct and ambient signal portions as a first output channel into one of the two first speakers, being a first horizontally arranged speaker, and wherein the apparatus for generating an output signal is adapted to feed another one of the at least two input channels with direct and ambient signal portions as a second output channel into another one of the two first speakers, being a second horizontally arranged speaker.

23. An apparatus according to claim 22, wherein the apparatus for generating an output signal is configured to feed no direct signal portions into the two second speakers, or to feed direct signal portions into the two second speakers which are attenuated with respect to the direct signal component fed into the two first speakers.

24. A method for generating an output signal having at least two output channels from an input signal having at least one input channel, wherein a first speaker of at least two speakers is placed in first heights in a listening environment with respect to a listener, wherein a second speaker of the at least two speakers is placed in second heights in a listening environment with respect to the listener, the second heights being different from the first heights, wherein the method comprises:

extracting at least one ambient signal with ambient signal portions from the at least one input channel, modifying the at least one ambient signal to obtain at least a first modified ambient signal, and feeding only the first modified ambient signal into the second speaker, and feeding the first input channel with direct and ambient signal portions into the first speaker being a first horizontally arranged speaker, wherein the method comprises adapting, via a function, to output only a first amount of ambient signal portions of one of at least two input channels to one of the plurality of output speakers, and wherein the method comprises outputting a remaining amount of the ambient signal portions of said one of the at least two input channels plus the direct signal portions of said one of the at least two input channels to another one of the plurality of speakers.

25. A method according to claim 24, wherein the output signal has at least four output channels being the at least two output channels, wherein the input signal has at least two input channels as the at least one audio input channel, wherein the method comprises the step of generating the output signal having the at least four output channels from the input signal having the at least two input channels, wherein the at least one ambient signal are at least two ambient signals, wherein the method comprises the step of extracting the at least two ambient signals with ambient signal portions from the at least two input channels, wherein the method comprises the step of modifying the at least two ambient signals to obtain at least the first modified ambient signal and a second modified ambient signal, wherein the at least two speakers are at least four speakers, wherein the first speaker is one of two first speakers of the at least four speakers, and wherein the second speaker is one of two second speakers of the at least four speakers, wherein the two first speakers are placed in the first heights in the listening environment with respect to the listener, wherein the two second speakers are placed in the second heights in the listening environment with respect to the listener, wherein the method comprises the step of feeding the first modified ambient signal as a third output channel into one of the two second speakers, and wherein the method comprises the step of feeding the second modified ambient signal as a fourth output channel into another one of the two second speakers, and wherein one of the at least two input channels with direct and ambient signal portions is fed as a first output channel into one of the two first speakers, being a first horizontally arranged speaker, and wherein another one of the at least two input channels with direct and ambient signal portions is fed as a second output channel into another one of the two first speakers, being a second horizontally arranged speaker.

26. A method according to claim 25, wherein no direct signal portions are fed into the two second speakers, or wherein direct signal portions are fed into the two second speakers which are attenuated with respect to the direct signal component fed into the two first speakers.

27. A non-transitory computer-readable medium comprising a computer program for performing the method of one of claims 24 to 26, when the computer program is executed by a computer or processor.

* * * * *